US008016410B2

(12) United States Patent
Sugiyama et al.

(10) Patent No.: US 8,016,410 B2
(45) Date of Patent: Sep. 13, 2011

(54) IMAGE RECORDING APPARATUS

(75) Inventors: Wataru Sugiyama, Aichi-ken (JP); Takashi Ohama, Iwakura (JP); Noriyuki Kawamata, Nagoya (JP); Yuta Uchino, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 412 days.

(21) Appl. No.: 12/053,839

(22) Filed: Mar. 24, 2008

(65) Prior Publication Data

US 2008/0239047 A1 Oct. 2, 2008

(30) Foreign Application Priority Data

Mar. 29, 2007 (JP) ..... 2007-087001

(51) Int. Cl.
*B41J 2/01* (2006.01)

(52) U.S. Cl. ..... 347/104

(58) Field of Classification Search ..... None
See application file for complete search history.

(56) References Cited

U.S. PATENT DOCUMENTS 7,108,368 B2 * 9/2006 Saito et al. ..... 347/104
2004/0096254 A1 * 5/2004 Sato et al. ..... 399/405
2004/0161106 A1 8/2004 Matsuda et al.
2004/0263553 A1 * 12/2004 Mizuno ..... 347/16

FOREIGN PATENT DOCUMENTS

JP 5004394 A 1/1993
JP 5051152 A 3/1993
JP 8132697 A 5/1996
JP 11209008 A 8/1999
JP 2003318883 A 11/2003

* cited by examiner

*Primary Examiner* — Stephen D Meier
*Assistant Examiner* — Alexander C Witkowski
(74) *Attorney, Agent, or Firm* — Baker Botts L.L.P.

(57) ABSTRACT

An image recording apparatus including a feeding device feeding a recording medium in a first direction along a first path, a recording portion disposed in the first path and located between an upstream and a downstream connecting portion of the first path to record an image on the medium, a second path connecting the downstream connecting portion to the upstream connecting portion, a path switching portion including a roller pair disposed downstream of the downstream connecting portion in the first direction and being capable of (i) ejecting the medium such that a first edge thereof is the leading edge, by rotating in a forward direction while the medium is nipped therebetween, and (ii) feeding the medium into the second path such that a second edge thereof opposite to the first edge is the leading edge, by rotating in a reverse while the medium is nipped therebetween.

21 Claims, 14 Drawing Sheets

IMAGE RECORDING APPARATUS

CROSS REFERENCE TO RELATED APPLICATION

The present application claims priority from Japanese Patent Application No. 2007-087001, which was filed on Mar. 29, 2007, the disclosure of which is herein incorporated by reference in its entity.

BACKGROUND OF THE INVENTION

1. Field of the Invention

The present invention relates to an image recording apparatus which records an image on both sides of a recording medium by turning over the recording medium, and particularly to an apparatus for turning over a recording medium.

2. Description of Related Art

There has been proposed an image recording apparatus that can record an image on both sides of a recording sheet, as disclosed in JP-A-11-209008, for instance. Such an image recording apparatus includes a sheet supply tray and a feed path. The sheet supply tray accommodates a recording sheet, and a recording portion is disposed in the feed path. The recording sheet is supplied from the sheet supply tray and fed along the feed path, during which the recording portion records an image on one (which may be referred to as a "first surface") of two opposite sides or surfaces of the recording sheet. Thereafter, the recording sheet is fed backward into a switch-back path by being nipped between a switchback roller pair. Via the switch-back path, the recording sheet is again fed to an upstream portion of the feed path, while being turned over. The upstream portion is a portion of the feed path located upstream of the recording portion. The recording portion records an image on the other side (which may be referred to as a "second surface" or "reverse side") of the recording sheet that has been turned over. The recording sheet is then ejected out of the image recording apparatus.

When the recording sheet is fed backward into the switch-back path by being nipped between the switchback roller pair, there is a possibility that friction resistance between the recording sheet and an inner wall surface of the switch-back path causes bending of an end portion of the recording sheet on the front or leading side in a feeding direction of the recording sheet.

In particular, where the recording portion is of inkjet type, ink droplets forming the image on the surface of the recording sheet are not evenly landed or distributed with respect to a width direction of the recording sheet, i.e., a direction perpendicular to the feeding direction, resulting in a variation in a rigidity and a friction coefficient of the recording sheet with respect to the width direction of the recording sheet. This widthwise variation in the rigidity and friction coefficient leads to an unevenness with respect to the width direction in an amount of bending of the recording sheet. Therefore, even when the recording sheet is not skewed at a portion thereof nipped between the switchback roller pair, the end portion of the recording sheet on the leading side may be disadvantageously skewed. Where the recording portion is not of inkjet type, the possibility of occurrence of such a skew is relatively low as compared to the case of inkjet type, but not completely free from the possibility thereof.

SUMMARY OF THE INVENTION

This invention has been developed in view of the above-described situations, and it is an object of the invention, therefore, to provide an image recording apparatus capable of preventing a skew of a recording medium such as a recording sheet in order to perform image recording on both sides of the recording medium with high precision.

To attain the above object, the invention provides an image recording apparatus including (a) a feeding device which feeds a recording medium in a first feeding direction along a first feed path including an upstream connecting portion and a downstream connecting portion, (b) a recording portion which is disposed in the first feed path and located between the upstream connecting portion and the downstream connecting portion to record an image on the recording medium, (c) a second feed path which connects the downstream connecting portion to the upstream connecting portion, (d) a path switching portion which includes a roller pair disposed downstream of the downstream connecting portion with respect to the first feeding direction, the roller pair being capable of (i) ejecting the recording medium such that a first edge of the recording medium is the leading edge, by rotating in a forward direction while the recording medium is nipped therebetween, and (ii) feeding the recording medium into the second feed path such that a second edge of the recording medium opposite to the first edge is the leading edge, by rotating in a reverse direction while the recording medium is nipped therebetween, (e) a feed roller which is disposed in the second feed path and feeds the recording medium in a second feeding direction along the second feed path, into the first feed path at the upstream connecting portion, and (D a momentary-forward-rotation controller which implements, while the roller pair is feeding the recording medium into the second feed path and before the feed roller initiates the feeding of the recording medium toward the upstream connecting portion of the first path, a momentary forward rotation of the roller pair by temporarily switching the rotation direction of the roller pair to the forward direction from the reverse direction in order to feed the recording medium in a direction opposite to the second feeding direction.

The recording medium fed into the first feed path is further fed to a position corresponding to the recording portion, which operates to record an image on a first surface of the recording medium. In a case where an image is recorded on only one side, i.e., the first surface, of the recording medium, the path switching portion feeds the recording medium to the downstream side in the first feeding direction in order to eject the recording medium. On the other hand, when image recording is to be performed on a reverse side, i.e., a second surface, of the recording medium, too, the path switching portion feeds the recording medium into the second feed path, such that while the recording medium is nipped between the roller pair, the roller pair is rotated in the reverse direction to feed the recording medium into the second feed path with the second edge thereof being the leading edge. The second edge is the edge opposite to the first edge that was the leading edge when the recording medium was fed along the first feed path. The recording medium fed into the second feed path is fed by the feed roller again to the recording portion via the upstream connecting portion, during which the recording medium is turned over. The recording portion then records an image on the reverse side or the second surface of the recording medium.

According to the invention, while the recording medium is fed along the second feed path by the roller pair being rotated in the reverse direction, and before the recording medium is fed toward the upstream connecting portion by the feed roller, the rotation direction of the roller pair is temporarily reversed from reverse to forward, namely, the roller pair is rotated again and temporarily in the forward direction. It is desirable that this momentary forward rotation is initiated after the second edge reaches a point in the second feed path distant from the feed roller by 30% of an entire distance across which the second edge of the recording medium moves with the feeding of the recording medium along the second feed path to the feed roller. It is further desirable that this momentary forward rotation is initiated after the second edge reaches a point distant from the feed roller by 20%, and still further desirably 10%, of the entire distance. When the momentary forward rotation is initiated before the second edge of the recording medium being fed along the second feed path reaches the feed roller, the feeding of the recording medium by the feed roller toward the upstream connecting portion of the first feed path is not initiated, even in a case where the feed roller is already rotating while the recording medium is fed along the second feed path. On the other hand, where the recording medium is fed along the second feed path while the feed roller is not rotating, the feeding of the recording medium by the feed roller toward the upstream connecting portion of the first feed path is not initiated even when the momentary forward rotation is initiated after the second edge reaches, or comes into contact with, the feed roller and stops. By this momentary forward rotation of the roller pair, the recording medium fed into the second feed path is fed backward, namely, toward the path switching portion, by an appropriate amount. Therefore, an unevenness in bending of the recording medium in the width direction of the recording medium is eliminated or reduced, thereby reducing a skew of the recording medium at the time of feeding the recording medium by the feed roller again to the recording portion. Thus, image recording can be performed excellently on the both sides or surfaces of the recording medium.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF PREFERRED EMBODIMENTS

Hereinafter, there will be described a multifunction apparatus according to one presently preferred embodiment of the invention, by referring to the accompanying drawings. It is to be understood, however, that the invention is not limited to the details of the embodiment, but may be otherwise embodied with various modifications and improvements that may occur to those skilled in the art, without departing from the scope and spirit of the invention defined in the appended claims.

1. General Structure and Features of the Embodiment

Figure 1:
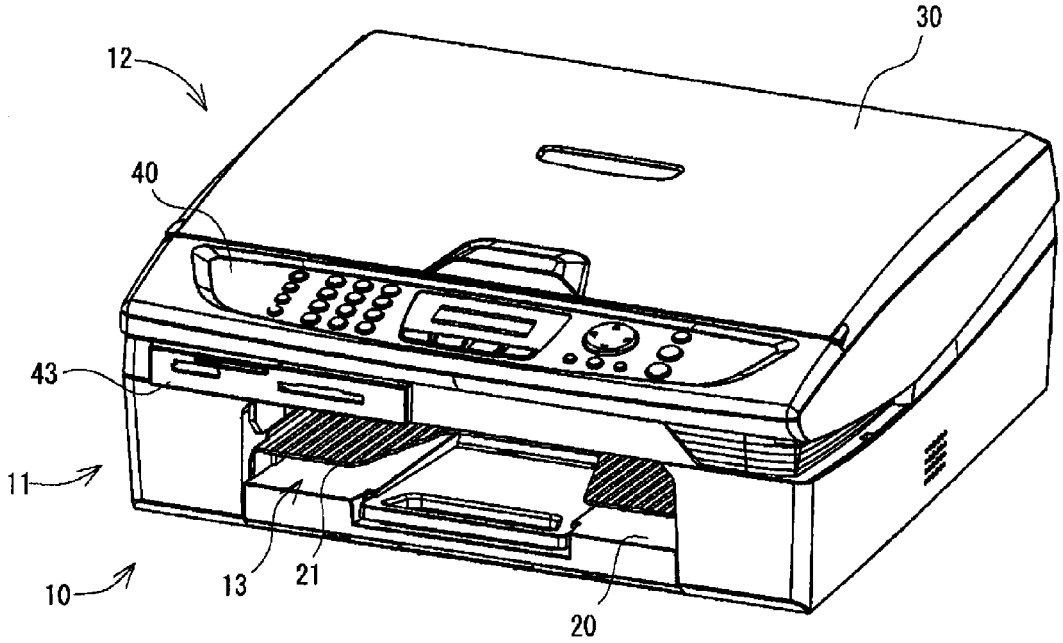
FIG. 1 is an external perspective view of a multifunction apparatus according to one embodiment of the invention.
Figure 2:
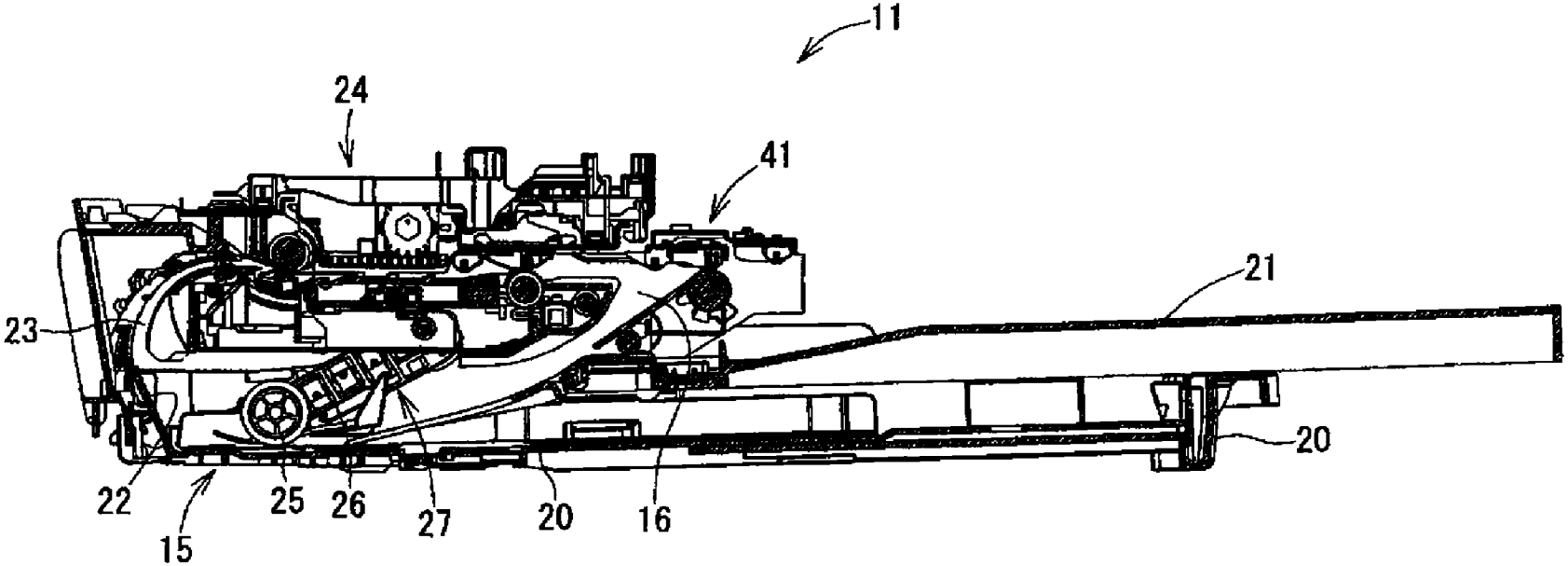
FIG. 2 is a vertical cross-sectional view of the multifunction apparatus.

In FIG. 1, reference numeral 10 generally denotes the multifunction apparatus 10, and reference numerals 11 and 12 respectively denote a printer portion and a scanner portion of the multifunction apparatus 10. FIG. 2 is a vertical cross-sectional view showing a structure of the printer portion 11.

The multifunction apparatus 10 is a MFD (Multi Function Device) having a printer function, a scanner function, a copier function, and a facsimile function. According to this embodiment, an image recording apparatus of the invention is implemented in the form of the printer portion 11. Hence, the other functions of the multifunction apparatus 10 than the printer function are optional and not essential.

As shown in FIG. 1, the printer portion 11 constitutes a lower part of the multifunction apparatus 10. As shown in FIG. 2, inside the printer portion 11 are formed a feed path 23 and a switch-back guide path 16 that respectively correspond to a first feed path and a second feed path. Along the feed path 23, a recording sheet as a recording medium, which may be a cut sheet of paper, is fed in a first feeding direction. The printer portion 11 includes a pickup portion 15, a recording portion 24, an ejection roller 62 and a spur or gear roller 63 (both shown in FIG. 3), and a catch tray 21. The pickup portion 15 operates to supply recording sheets one by one into the feed path 23. The recording portion 24 operates to record an image on the thus supplied recording sheet by ejecting droplets of ink onto the recording sheet. The ejection roller 62 and the gear roller 63 cooperate to feed the recording sheet in the first feeding direction. The recording sheet is ejected out of the printer portion 11 onto the catch tray 21. The multifunction apparatus 10 can record an image on both of two opposite sides (a first side and a second side) of a recording sheet. When recording is to be performed on a reverse side or a second surface of a recording sheet after an image has been recorded on a first surface thereof, the recording sheet with an image on the first surface is fed from the feed path 23 into the switch-back guide path 16, by a path switching portion 41, more specifically, a roller pair 80 (shown in FIG. 4) constituted by a first roller 45 and a second roller 46. Then, the recording sheet is again fed into the feed path 23, with the reverse side or the second surface facing upward, that is, the recording sheet is turned over. When the recording sheet is again fed to a position corresponding to the recording portion 24, an image is recorded on the recording sheet having been turned over, that is, this time an image is recorded on the second surface of the recording sheet.

A feature of the multifunction apparatus 10 resides in the manner in which the recording sheet with an image having been recorded on its first surface is fed. That is, after recording on the first surface is complete, the recording sheet is fed by the ejection roller 62 and the gear roller 63 to the downstream side in the first feeding direction, and then fed into the switch-back guide path 16 by the first roller 45 and the second roller 46. When the recording sheet fed into the switch-back guide path 16 reaches a predetermined position, the recording sheet is reversed, that is, fed backward, by a predetermined amount, which will be described later and referred to as "reverse feed amount KL". By this backward feeding of the recording sheet, even when the recording sheet fed into the switch-back guide path 16 is bent unevenly with respect to a lateral or a width direction thereof the widthwise unevenness in bending of the recording sheet is eliminated or reduced.

As shown in FIG. 1, the scanner portion 12 constitutes an upper portion of the multifunction apparatus 10. The scanner portion 12 takes the form of a so-called flat bed scanner, and includes a document cover 30 constituting a top board of the multifunction apparatus 10. Although not shown in FIG. 1, a platen glass is disposed under the document cover 30. An image on a document that is set on the platen glass is read while covered with the document cover 30.

An operation panel 40 is disposed in an upper front portion of the multifunction apparatus 10. Through the operation panel 40, a user can operate the printer portion 11 and the scanner portion 12. The operation panel 40 includes various kinds of manual operation buttons and a liquid crystal display. The multifunction apparatus 10 operates in response to an instruction inputted through the operation panel 40. For instance, the user can set the kind of recording sheet to be used through manipulation of the operation panel 40. In this specific example, the kind of the recording sheet to be used is selected from regular paper sheet and postcard. Through manipulation of the operation panel 40, the user can also set image recording mode and resolution. The image recording mode is selected from "one-side mode" and "two-side mode". When the one-side mode is selected, recording is performed only on one side of each recording sheet. When the two-side mode is selected, recording is performed on both sides of each recording sheet. The resolution is selected by making a selection between "draft mode" and "photo mode". In a case where the multifunction apparatus 10 is connected to an external computer, the multifunction apparatus 10 can also operate in response to an instruction transferred from the computer through a printer driver or a scanner driver. That is, in this case, the kind of recording sheet to be used, the image recording mode, the resolution, and other conditions of image recording can be set through the printer driver or the scanner driver. The multifunction apparatus 10 has a slot portion 43. Various kinds of small memory cards as storage media can be inserted in the slot portion 43. For instance, the user can record an image, data of which is stored in a small memory card inserted in the slot portion 43, on a recording sheet, by manipulating the operation panel 40 so as to read out the image data from the small memory card and record the image on the recording sheet.

2. Printer Portion

There will be described an internal structure of the multifunction apparatus 10, particularly that of the printer portion 11.

[2-1 Pickup Portion]

As shown in FIG. 1, an opening is formed at the front side of the printer portion 11. Inside the opening 13, a sheet supply tray 20 and the catch tray 21 are disposed in vertical relation, that is, the sheet supply tray 20 is located below the catch tray 21. As shown in FIG. 2, the pickup portion 15 includes the sheet supply tray 20, a pickup arm 26 with a pickup roller 25 corresponding to a feed roller of the invention, and a power transmitting mechanism 27 for operating the pickup roller 25.

The sheet supply tray 20 accommodates a recording sheet or a stack of recording sheets. The recording sheet or sheets are one by one supplied from the supply tray 20 into the printer portion 11. The sheet supply tray 20 is disposed at the bottom of the printer portion 11. On the rear side of the sheet supply tray 20, a slant separator plate 22 is disposed. The separator plate 22 is formed continuously with the feed path 23, and functions to separate a topmost one of a plurality of recording sheets that are together supplied from the sheet supply tray 20, from the rest of the recording sheets, and upward guide the thus separated topmost recording sheet. From the separator plate 22, the feed path 23 extends upward, and then turns from the rear side of the multifunction apparatus 10 (i.e., the left-hand side in FIG. 2) to the front side (i.e., the right-hand side in FIG. 2) of the multifunction apparatus 10 in a U-like shape, to end at the catch tray 21 through a position corresponding to the recording portion 24. Thus, the recording sheet supplied from the sheet supply tray 20 is guided upward from the lower side of the printer portion 11 in a U-turn manner along the feed path 23, then reaches the position corresponding to the recording portion 24 where image recording is performed, and thereafter ejected onto the catch tray 21.

Figure 3:
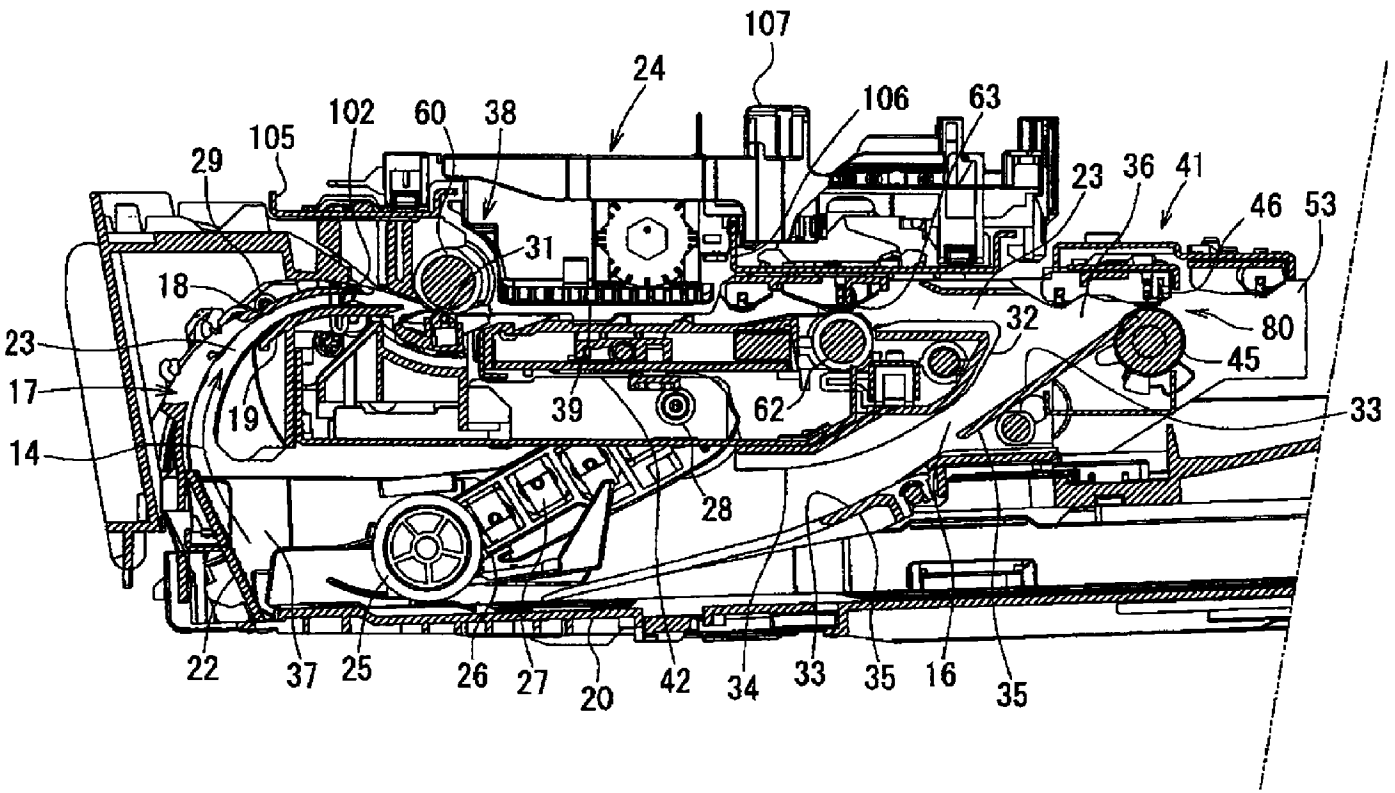
FIG. 3 is a cross-sectional view of a part of the multifunction apparatus in enlargement.

FIG. 3 is a cross-sectional view of a part of the printer portion 11 in enlargement.

As shown in FIG. 3, the pickup roller 25 is disposed over the sheet supply tray 20 so as to supply the recording sheets stacked on the sheet supply tray 20 one by one into the feed path 23. The pickup roller 25 is mounted on a shaft at a distal end of the pickup arm 26, and is rotated by receiving a driving power from a LF motor 71 (not shown in FIG. 3 but shown in FIG. 12) as a driving source via the power transmitting mechanism 27, which includes a plurality of gears in meshing engagement with one another.

The pickup arm 26 is supported by a pivot shaft 28. That is, a proximal end portion of the pickup arm 26 is supported around the pivot shaft 28 such that the pickup arm 26 is pivotable about the pivot shaft 28. Thus, the pickup arm 26 is vertically movable to contact with and separate from the sheet supply tray 20. The pickup arm 26 is downward biased by its own weight, by a spring, or otherwise. Hence, the pickup arm 26 is normally in contact with the sheet supply tray 20, and retracts upward when the sheet supply tray 20 is inserted into and pulled out of the opening 13. By the pickup arm 26 being held biased downward, the pickup roller 25 is held in pressing contact with the topmost one of the recording sheets on the sheet supply tray 20. When the pickup roller 25 is rotated in such a state, a frictional force occurs between a circumferential surface of the pickup roller 25 and the topmost recording sheet, thereby feeding the topmost recording sheet toward the separator plate 22. When a leading edge of the recording sheet comes into contact with the separator plate 22, the recording sheet is guided upward by the separator plate 22 and fed in a direction indicated by arrow 14 into the feed path 23. There is a possibility that when the topmost recording sheet is thus supplied by the pickup roller 25, the next recording sheet, or the recording sheet immediately under the topmost recording sheet, is together supplied due to an effect of friction or electrostatic. However, the next recording sheet is inhibited by the separator plate 22 from being further fed by the contact therebetween.

Except a part corresponding to the recording portion 24, the feed path 23 is defined between an outer guide surface and an inner guide surface. For instance, at a curved portion 17 at the rear side of the multifunction apparatus 10, the feed path 23 is defined between an outer guide member 18 and an inner guide member 19 that are fixed to a mainbody frame 53. That is, at the curved portion 17, the outer guide member 18 provides the outer guide surface, and the inner guide member 19 provides the inner guide surface. The outer guide member 18 and the inner guide member 19 are disposed to be opposed to each other with a spacing therebetween. In the curved portion 17 of the feed path 23, a roller 29 is disposed. The roller 29 is freely rotatable, and a circumferential surface of the roller 29 is exposed from the outer guide surface. Hence, even at the curved portion 17 of the feed path 23, each recording sheet is smoothly feedable.

[2-2 Recording Portion]

The recording portion 24 is disposed at a position in the feed path 23 as shown in FIG. 3, and includes a carriage 38 and an inkjet recording head 39 mounted on the carriage 38. The carriage 38 is reciprocated along guide rails 105, 106 in a main scanning direction, which is vertical to a surface of the sheet on which FIG. 3 is presented. More specifically, the carriage 38 is driven or slid by a CR motor 95 (shown in FIG. 12) as a drive source, via a belt drive mechanism, for instance. In the multifunction apparatus 10, an ink cartridge (not shown in FIG. 3) is disposed separately from the inkjet recording head 39. Ink is supplied from the ink cartridge to the inkjet recording head 39 through an ink tube. An image is recorded on a recoding sheet being fed over a platen 42, by the inkjet recording head 39 ejecting the ink in the form of minute droplets onto the recording sheet while the carriage 38 is reciprocated.

Although not shown in FIG. 3, a linear encoder 85 (shown in FIG. 12) is disposed on the mainbody frame 53 of the multifunction apparatus 10. The linear encoder 85 detects the position at which the carriage 38 is located. An encoder strip of the linear encoder 85 is disposed on the guide rails 105, 106. The encoder strip has light-transmission parts and light-blocking parts. At each of the light-transmission parts, light is allowed to transmit, and at each of the light-blocking part, light is inhibited from transmitting. The light-transmission parts and the light-blocking parts are alternately arranged at a pitch along a longitudinal direction of the encoder strip, forming a pattern. An optical sensor 107, which is a transmission sensor, is disposed on an upper surface of the carriage 38, at a position corresponding to the encoder strip. The optical sensor 107 is reciprocated with the carriage 38 along the longitudinal direction of the encoder strip, thereby detecting the pattern of the encoder strip.

The recording portion 24 has a head control board for controlling the ink ejection. The head control board outputs a pulse signal based on the result of the detection of the pattern of the encoder strip by the optical sensor 107. From the pulse signal, the current position of the carriage 38 is determined, based on which reciprocation of the carriage 38 is controlled.

Figure 12:
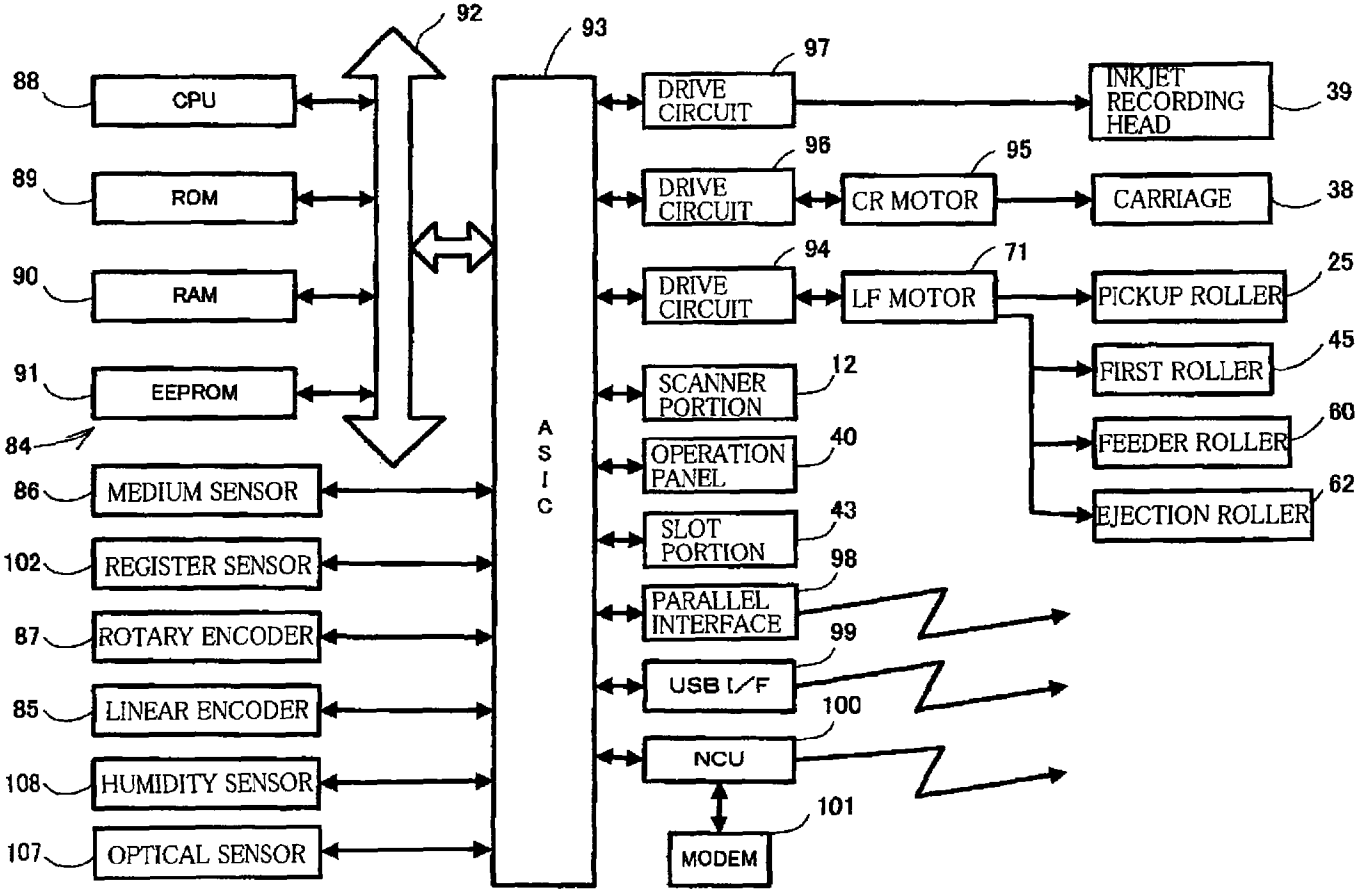
FIG. 12 is a block diagram showing a control portion of the multifunction apparatus.

Although not shown in FIG. 3, the carriage 38 has a medium sensor 86 (shown FIG. 12). The medium sensor 86 detects presence or non-presence of a recording sheet over the platen 42, and has a light source and a light receiving element. The light source can downward emit light. The light emitted is incident on the recording sheet being fed over the platen 42, when there it is. On the other hand, when the recording sheet is not yet fed over the platen 42, the light emitted from the light source is incident on the platen 42. The light incident on the recording sheet or the platen 42 is reflected thereby. The light receiving element receives the reflected light and outputs a signal corresponding to a value representing an amount of the received light, which is so-called AD value, i.e., a voltage value. With the carriage 38 slid as described above, the medium sensor 86 scans or reciprocates over the platen 42. A control portion 84 detects that a recording sheet is present or not present over the platen 42 on the basis of the AD value.

[2-3 Switch-back Path]

As shown in FIG. 3, the switch-back guide path 16 is connected with the feed path 23. That is, the switch-back guide path 16 is continuous with a portion 36 of the feed path 23 downstream of the recording portion 24. The switch-back guide path 16 constitutes a switch-back path for directing a recording sheet with an image having been recorded on one of two sides thereof (or a first surface thereof again to a position over the sheet supply tray 20. The switch-back guide path 16 is defined between a first guide surface 32 and a second guide surface 33. In the present embodiment, the first guide surface 32 and the second guide surface 33 are provided by surfaces of guide members 34, 35 disposed inside the mainbody frame 53 of the multifunction apparatus 10. The guide members 34, 35 are disposed to be opposed to each other with a spacing therebetween, and the first and second guide surfaces 32, 33 extend obliquely downward from the downstream portion 36 of the feed path 23 toward the pickup roller 25.

Hence, while the two-side mode is selected as the image recording mode, the recording sheet with an image having been recorded on its first surface is again fed by the pickup roller 25 to a portion 37 of the feed path 23 upstream of the recording portion 24. The recording sheet is then fed in the U-turn manner in the direction indicated by arrow 14 as described above, and an image is recorded by the recording portion 24 on the other side, or a reverse side or a second surface, of the recording sheet which is opposite to the side or surface on which an image has been already recorded. In this embodiment, the switch-back guide path 16 is formed to feed the recording sheet back onto the sheet supply tray 20. However, the form of the switch-back guide path 16 is not limited thereto. As long as the switch-back guide path 16 connects the downstream portion 36 of the feed path 23 to the upstream portion 37 of the same 23, the switch-back guide path 16 may take any other forms. That is, it should only be arranged such that the recording sheet is fed back to a position in the feed path 23 upstream of the upstream portion 37, or a position between the upstream portion 37 and the sheet supply tray 20.

[2-4 Sheet Feeding System]

As shown in FIG. 3, at a position in the feed path 23 upstream of the recording portion 24, a feeding roller 60 and a pinch roller 31 are disposed. These rollers 60, 31 are paired, and the pinch roller 31 is disposed below the feeding roller 60 in pressing contact therewith. When a recording sheet fed along the first feed path 23 reaches the feeding roller 60 and the pinch roller 31, these rollers 60, 31 nip therebetween the recording sheet and feed the recording sheet to a position over the platen 42. At a position in the feed path 23 downstream of the recording portion 24, a roller pair 61 constituted by the ejection roller 62 and the gear roller 63 is disposed. The ejection roller 62 and the gear roller 63 nip therebetween the recording sheet on which an image has just been recorded, to further feed the recording sheet to the downstream side toward the catch tray 21.

The feeding roller 60 and the ejection roller 62 are driven by the LF motor 71 as a drive source, in synchronization with each other. While an image is being recorded, these rollers 60, 62 are intermittently rotated. Thus, image recording is performed while the recording sheet is fed at a pitch corresponding to a predetermined linefeed width. Although not shown in FIG. 3, the feeding roller 60 is provided with a rotary encoder 87 (shown in FIG. 12), which detects, by means of an optical sensor, a pattern of an encoder disc (not shown) rotating with the feeding roller 60. Based on a signal outputted from the optical sensor, rotations of the feeding roller 60 and the ejection roller 62 are controlled. Before initiation of recording of an image and after termination of the recording of the image, the feeding roller 60 and the ejection roller 62 are continuously driven so as to feed the recording sheet at high speed.

The gear roller 63 is pressed against the recording sheet on which an image has just been recorded. In order not to degrade the quality of the image recorded on the recording sheet, a circumferential surface of the gear roller 63 is jaggy or geared. The gear roller 63 is slidable in a direction to contact with and separate from the ejection roller 62. The gear roller 63 is biased to be held in pressing contact with the ejection roller 62. As a means for biasing the gear roller 63 against the ejection roller 62, a coil spring is typically employed. Although not shown in FIG. 3, in this embodiment a plurality of the gear rollers 63 are arranged in a direction perpendicular to the first feeding direction, i.e., in the lateral or width direction of recording sheet, at constant intervals. The number of the gear rollers 63 is not especially limited, but eight gear rollers 63 are provided in this embodiment.

When a recording sheet reaches the nip between the ejection roller 62 and the gear roller 63, the gear roller 63 retracts against a biasing force of the coil spring by an amount corresponding to a thickness of the recording sheet. The recording sheet is contacted by the ejection roller 62 with a pressing force, and thus a rotating force of the ejection roller 62 is stably transmitted to the recording sheet. Similarly, the pinch roller 31 is elastically biased against the feeding roller 60, and thus the recording sheet is contacted by the feeding roller 60 with a pressing force, and a rotating force of the feeding roller 60 is stably transmitted to the recording sheet.

A register sensor 102 is disposed in the feed path 23 at a position upstream of the feeding roller 60. The register sensor 102 has a detector and an optical sensor. The detector is disposed across the feed path 23 such that the detector can advance into, and retract from, the feed path 23. The detector is elastically biased to be normally held advanced or protruding in the feed path 23. When the recording sheet being fed along the feed path 23 comes into contact with the detector, the detector is retracted into a wall defining the feed path 23. In accordance with the advancing and retracting movement of the detector into and from the feed path 23, the optical sensor turns on and off. Thus, the position of the leading edge or a trailing edge of the recording sheet in the feed path 23 is detected.

In the multifunction apparatus 10, the LF motor 71 functions as a drive source for supplying a recording sheet from the sheet supply tray 20, for feeding the recording sheet over the platen 42, and for ejecting the recording sheet, on which image recording is complete, onto the catch tray 21. That is, the LF motor 71 drives the feeding roller 60, drives the pickup roller 25 via the power transmitting mechanism 27 as described above, and drives the ejection roller 62 via a power transmitting mechanism that may be constituted by a series of gears or may include a timing belt depending on a space allotted for the power transmitting mechanism.

[2-5 Path Switching Portion]

Figure 4:
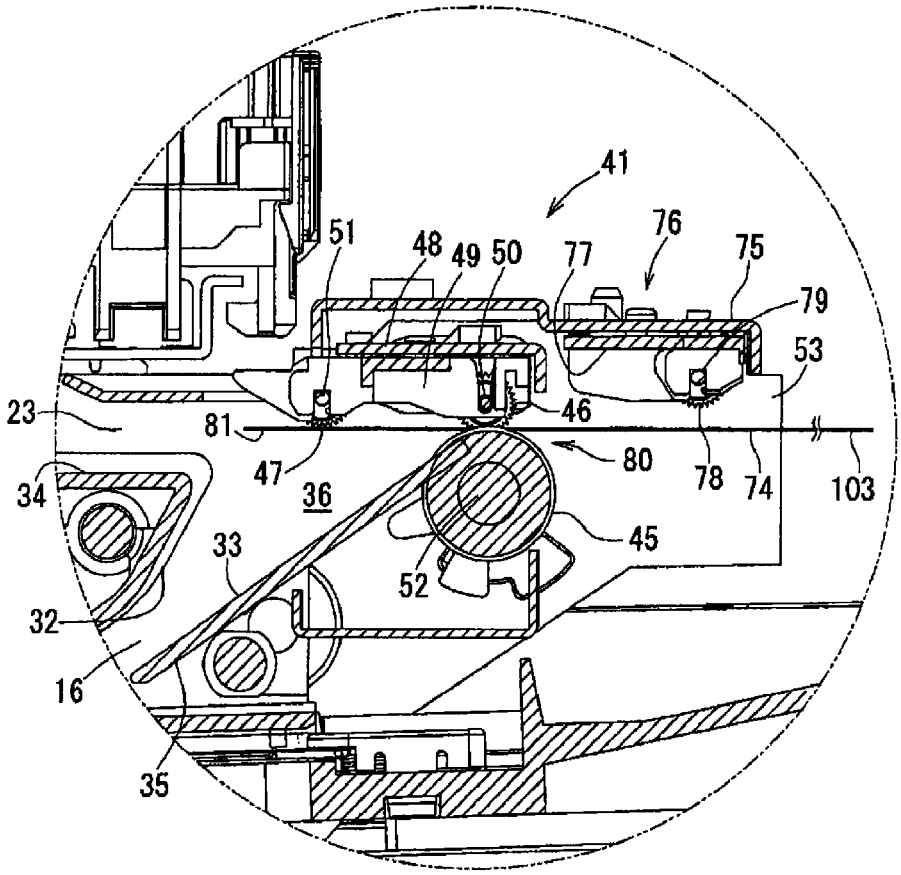
FIG. 4 is an enlarged view of a relevant part in FIG. 3.
Figure 5:
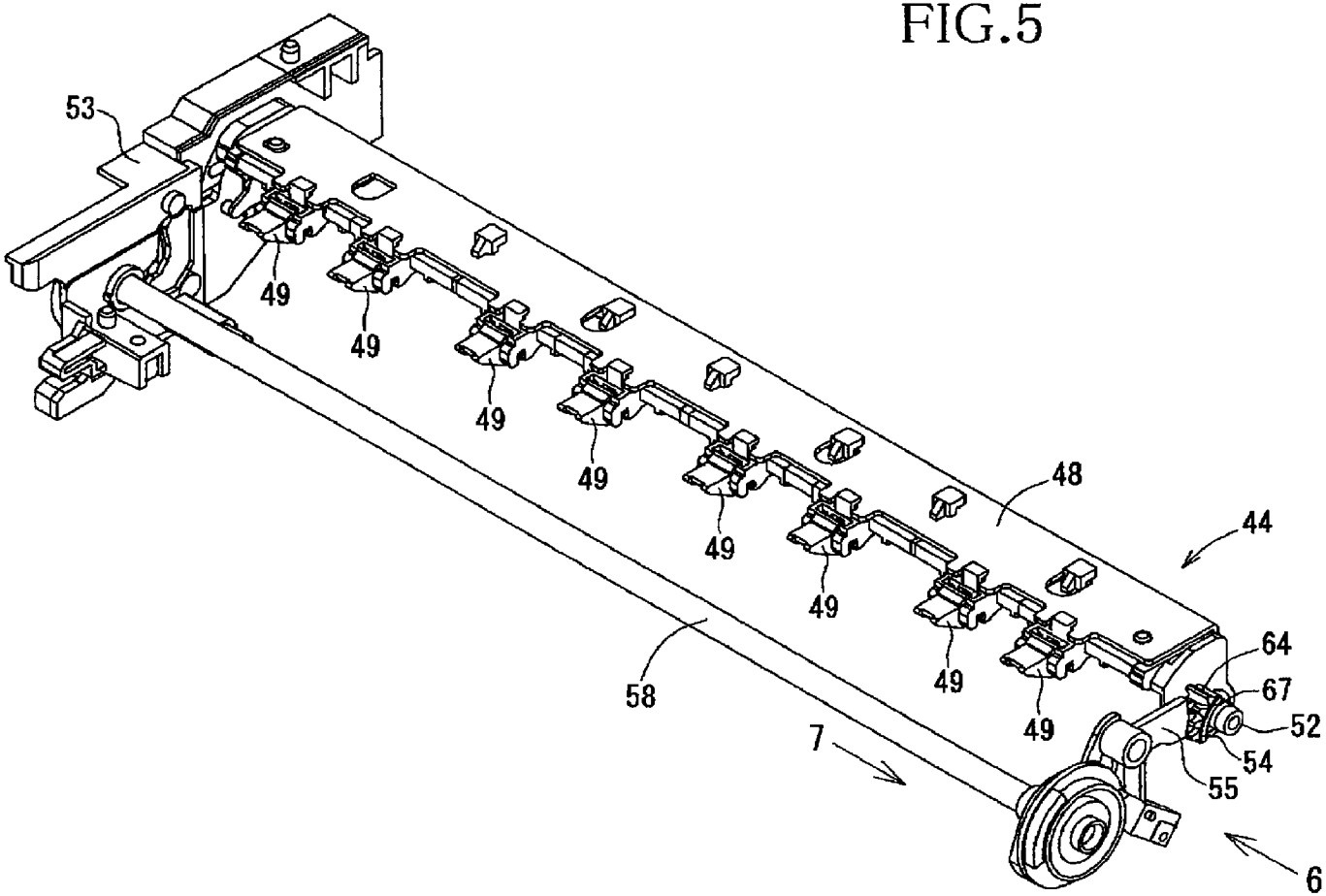
FIG. 5 is a perspective view of a drive mechanism for a path switching portion of the multifunction apparatus.
Figure 6:
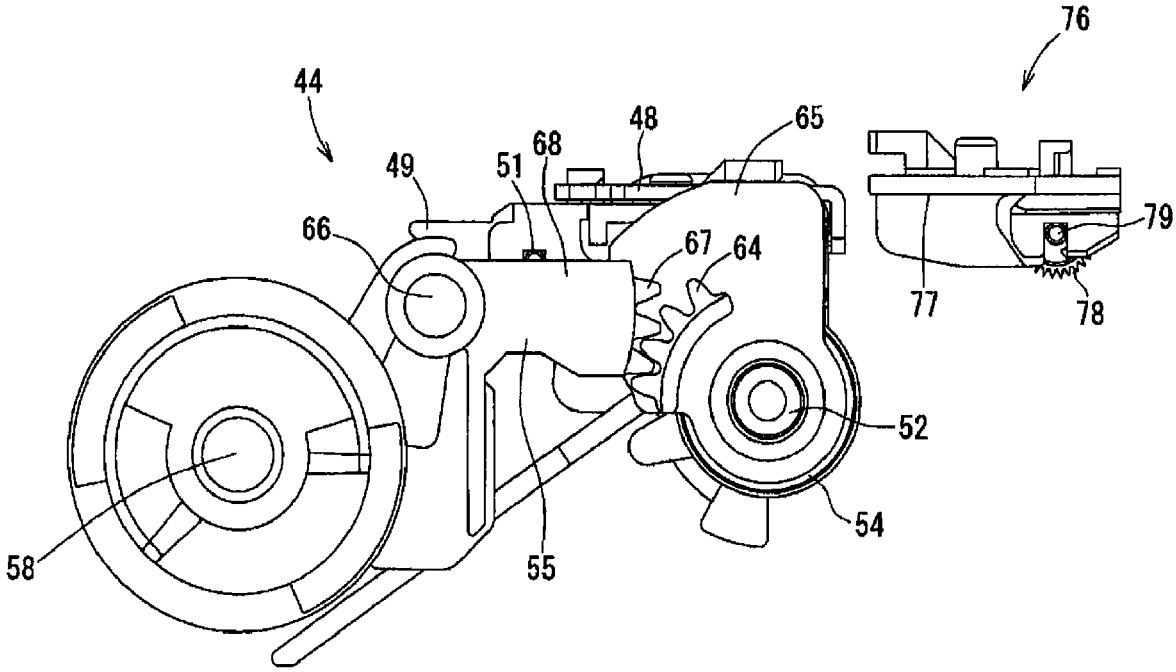
FIG. 6 is a view as seen in a direction indicated by arrow 6 in FIG. 5.
Figure 7:
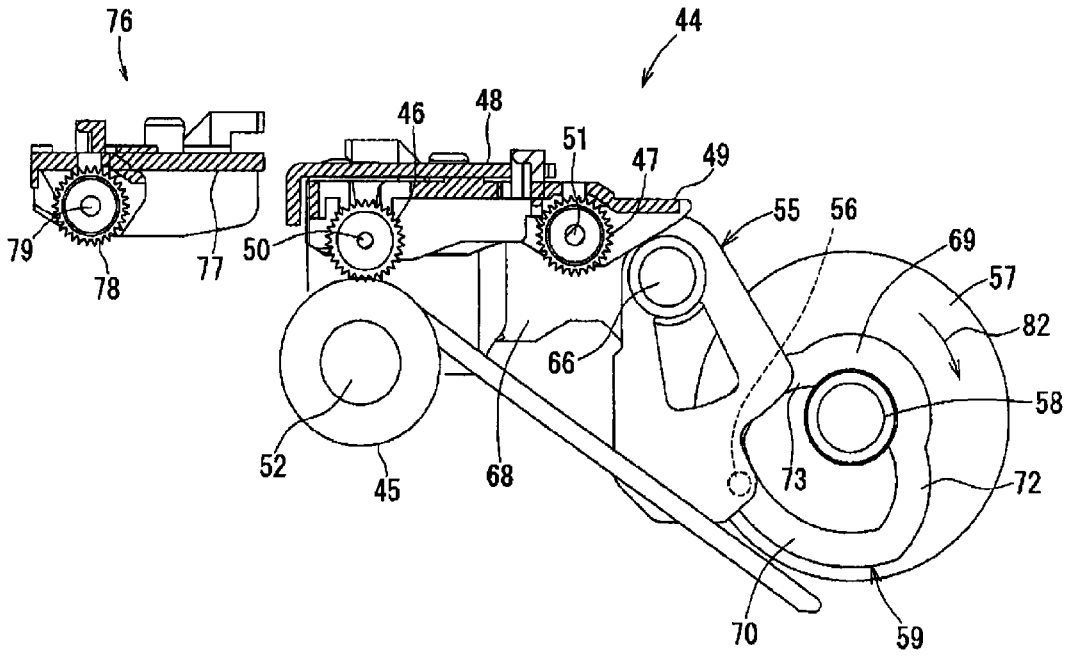
FIG. 7 is a partially cross-sectional view as seen in a direction indicated by arrow 7 in FIG. 5.

FIG. 4 is an enlarged view of a relevant part of FIG. 3, and shows in detail a vertical cross-section of the path switching portion 41. FIG. 5 is a perspective view of a drive mechanism 44 of the path switching portion 41. FIGS. 6 and 7 are views as seen in directions indicated by arrows 6 and 7 in FIG. 5, respectively.

As shown in FIGS. 3 and 4, the path switching portion 41 is disposed at a position in the feed path 23 downstream of the recording portion 24. More specifically, the path switching portion 41 is disposed in the portion 36 of the feed path 23 downstream of the recording portion 24. That is, the path switching portion 41 is disposed at the downstream side of a boundary portion between the feed path 23 and the switch-back guide path 16. The path switching portion 41 includes the first roller 45 and the second roller 46 constituting a roller pair 80, and an auxiliary roller 47 disposed adjacent to the second roller 46.

As described in detail later, the first roller 45 and the second roller 46 nip therebetween the recording sheet (denoted by reference numeral 74 in FIGS. 4 and 11) fed by and from the ejection roller 62 and the gear roller 63. The first roller 45 and the second roller 46 can feed the recording sheet 74 along the feed path 23 further to the downstream side (i.e., toward the catch tray 21), as well as can feed the recording sheet 74 backward or in a reverse direction into the switch-back guide path 16.

The second roller 46 and the auxiliary roller 47 are attached to a frame 48, which extends in a lateral direction of the multifunction apparatus 10 (i.e., a direction vertical to a surface of the sheet on which FIG. 3 is presented). The frame 48 is substantially L-shaped in cross section as shown in FIG. 4, thereby exhibiting a flexural rigidity as required.

As shown in FIGS. 4 and 5, eight sub frames 49 are formed integrally with the frame 48. The sub frames 49 are arranged in the lateral direction of the multifunction apparatus 10 at respective positions symmetrical with respect to a center in the lateral direction. Each of the sub frames 49 has a second roller 46 and an auxiliary roller 47. Hence, in total the frame 48 has eight second rollers 46 and eight auxiliary rollers 47, which are arranged in a direction perpendicular to the first feeding direction, i.e., in the width direction of the recording sheet, at constant spacing intervals. As described above, a plurality of the gear rollers 63 are arranged in the width direction of the recording sheet at constant spacing intervals, and the gear rollers 63 are supported in the same manner as the second rollers 46 are.

The second roller 46 and the auxiliary roller 47 are supported by respective support shafts 50, 51 (shown in FIG. 4) disposed on the sub frame 49, such that the second roller 46 and the auxiliary roller 47 are rotatable around the respective support shafts 50, 51. In this embodiment, the second roller 46 and the auxiliary roller 47 are gear rollers having a spur-like shape. The auxiliary roller 47 is disposed upstream of the second roller 46 with a spacing therebetween in the first feeding direction. The second roller 46 is biased downward as seen in FIG. 4 by a spring (not shown). Hence, the second roller 46 is normally held pressed elastically against the first roller 45.

The first roller 45 is rotated by the LF motor 71 as a drive source. Although not shown, the first roller 45 is connected with the LF motor 71 via a power transmitting mechanism. As shown in FIG. 5, the first roller 45 has a central shaft 52, which is supported by the mainbody frame 53. With the central shaft 52, the power transmitting mechanism is connected. The central shaft 52 may be provided with a bracket as needed, and the central shaft 52 is stably supported by the mainbody frame 53, such that the bracket is screwed to the mainbody frame 53 for instance.

Above the first roller 45, the second roller 46 is disposed. The first roller 45 may be formed as a single long columnar member, or as eight rollers disposed to be opposed to the second rollers 46. The first roller 45 is rotatable by the LF motor 71 in two opposite directions, i.e., a forward direction and a reverse direction. The recording sheet 74 fed along the feed path 23 reaches a pinch portion between the first roller 45 and the second roller 46 to be nipped. When the first roller 45 rotates in the forward direction while the recording sheet 74 is nipped between the first roller 45 and the second roller 46, the recording sheet 74 is fed to the downstream side in the first feeding direction and ejected onto the catch tray 21. On the other hand, when the first roller 45 rotates in the reverse direction, the recording sheet 74 nipped between the first roller 45 and the second roller 46 is fed backward or in a direction opposite to the first feeding direction, i.e., fed to the upstream side in the first feeding direction. In this embodiment, an external diameter of the first roller 45 is slightly larger than an external diameter of the ejection roller 62. That is, when the two rollers 45, 62 are rotated at a same speed, a circumferential speed of the first roller 45 is higher than that of the ejection roller 62. Thus, while the recording sheet 74 is fed by the ejection roller 62 and the first roller 45 that are rotating, the recording sheet 74 receives a pulling force in the first feeding direction and is held strained.

As shown in FIGS. 5-7, the drive mechanism 44 includes a driven gear 54, a drive gear 55, and a cam 57. The driven gear is disposed on the central shaft 52. The drive gear 55 is in meshing engagement with the driven gear 54, and also engaged with the cam 57 via a pin 56 formed on the drive gear 55 as a cam follower. The cam 57 has a rotating shaft 58 driven by the LF motor 71 as a drive source. As shown in FIG. 7, the cam 57 has a cam groove 59 formed in an annular shape around the rotating shaft 58. More specifically, the cam groove 59 has a small arc portion 69, a large arc portion 70, a first connecting portion 72, and a second connecting portion 73. Each of the small and large arc portions 69, 70 extends around the rotating shaft 58. The first connecting portion 72 extends between one of two opposite ends of the small arc portion 69 and one of two opposite ends of the large arc portion 70. The second connecting portion 73 extends between the other end of the small arc portion 69 and the other end of the large arc portion 70. The pin 56 is fitted in the cam groove 59 such that the pin 56 is slidable along the cam groove 59.

As shown in FIGS. 5 and 6, the driven gear 54 has a tooth portion 64 and a flange portion 65. The tooth portion 64 is formed as an involute gear around the central shaft 52. The tooth portion 64 is fitted on the central shaft 52, and rotatable around the central shaft 52. The flange portion 65 is formed integrally with the tooth portion 64, and connected with the frame 48. Thus, when the tooth portion 64 rotates, the frame 48, the sub frames 49, the second rollers 46, and the auxiliary rollers 47 integrally rotate or turn around the central shaft 52.

The drive gear 55 is supported by a support shaft 66 such that the drive gear 55 is rotatable around the support shaft 66. The support shaft 66 is disposed on the mainbody frame 53. The drive gear 55 has a tooth portion 67 and an arm portion 68, and the pin 56 protrudes from the arm portion 68. The tooth portion 67 of the drive gear 55 is formed as an involute gear around the support shaft 66, and is in meshing engagement with the tooth portion 64 of the driven gear 54. Rotation of the tooth portion 67 of the drive gear 55 rotates the tooth portion 64 of the driven gear 54, which in turn rotates the frame 48, the sub frames 49, the second rollers 46, and the auxiliary rollers 47 integrally around the central shaft 52.

Figure 8:
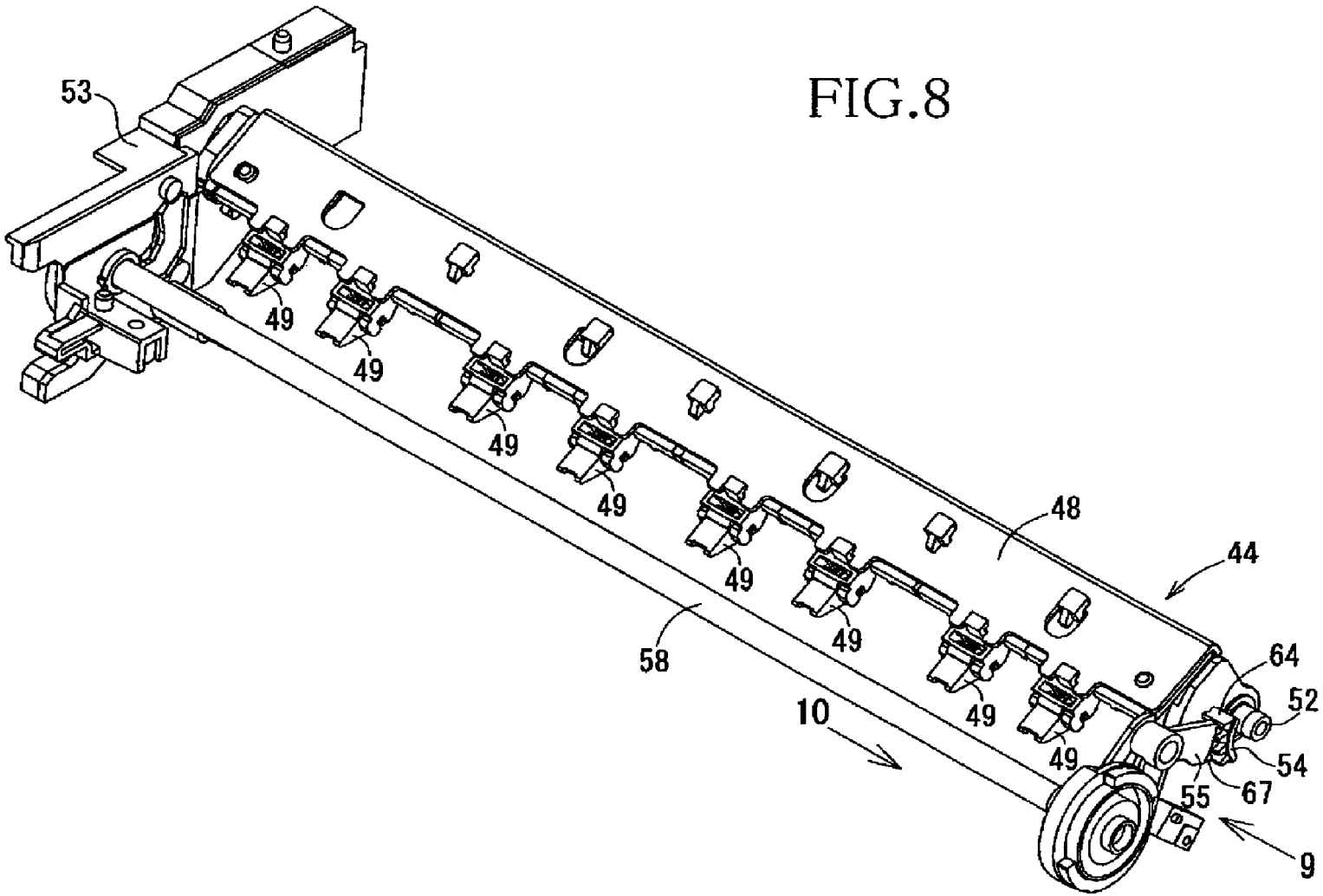
FIG. 8 is another perspective view of the driving mechanism.
Figure 9:
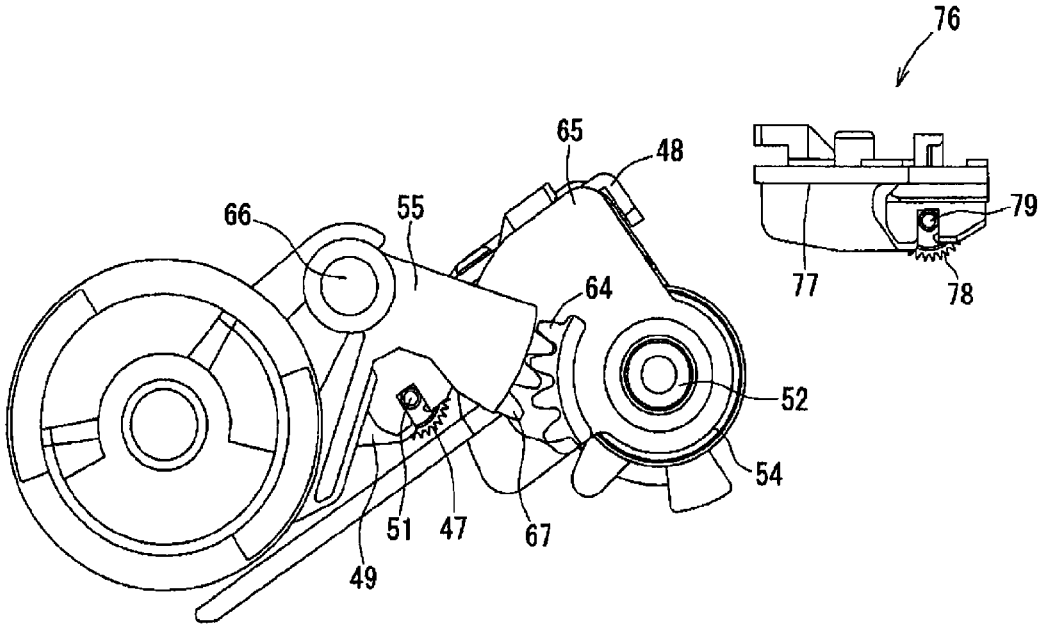
FIG. 9 is a view as seen in a direction indicated by arrow 9 in FIG. 8.
Figure 10:
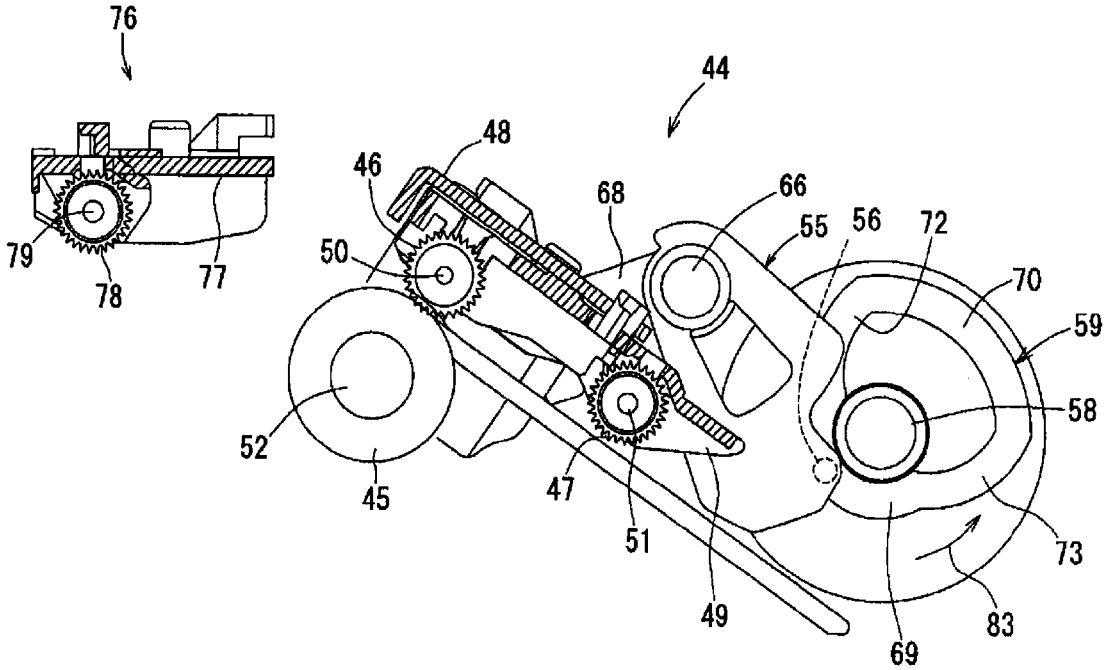
FIG. 10 is a partially cross-sectional view as seen in a direction indicated by arrow 10 in FIG. 8.
Figure 11:
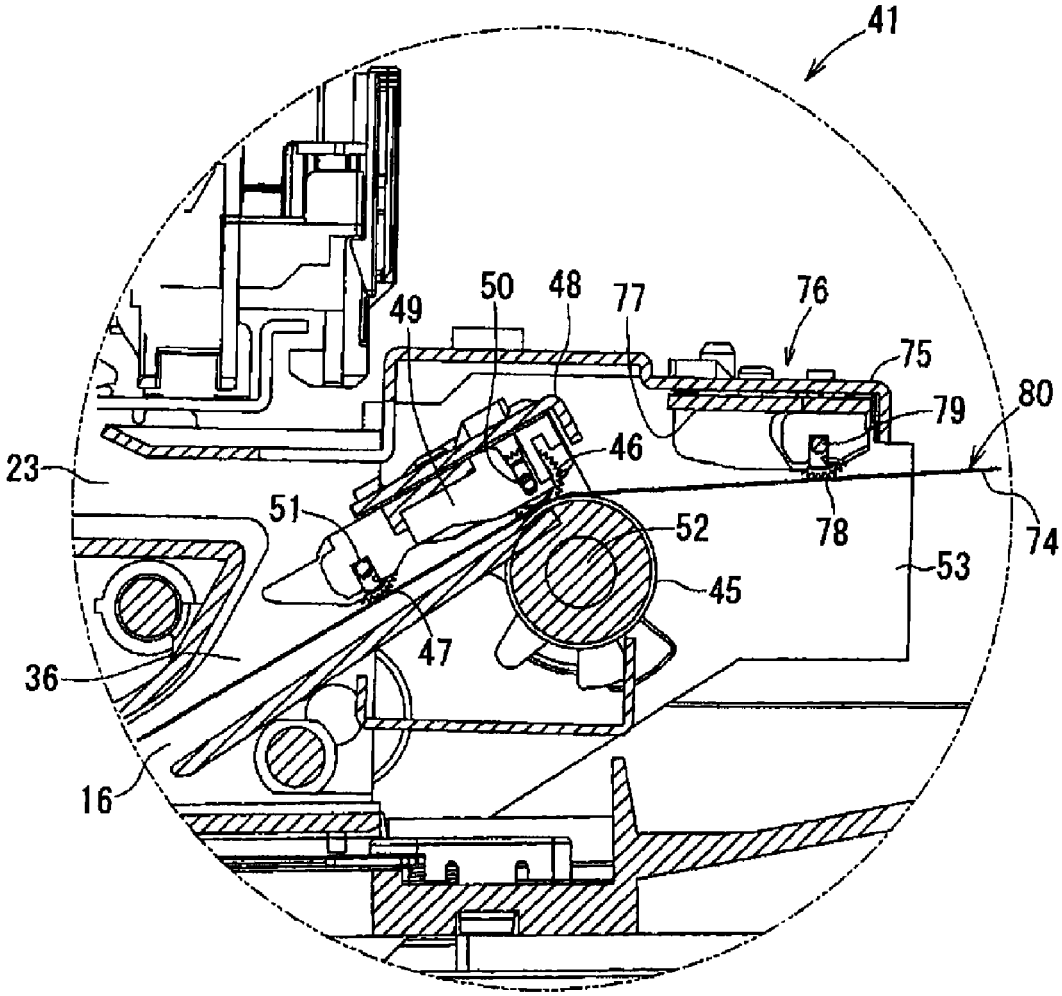
FIG. 11 is an enlarged view of a relevant part in FIG. 3.

FIG. 8 is a perspective view showing the drive mechanism 44 of the path switching portion 41, in a state where the frame 48, the sub frames 49, the second rollers 46, and the auxiliary rollers 47 are rotated. FIGS. 9 and 10 are views as seen in directions indicated by arrows 9 and 10 in FIG. 8, respectively. FIG. 11 is an enlarged view of a relevant part in FIG. 3, in a state where the path switching portion 41 is rotated around the central shaft 52.

As shown in FIG. 7, as the cam 57 rotates, the pin 56 moves relative to the cam 57 along the cam groove 59. In particular, when sliding along the first and second connecting portions 72, 73, the pin 56 moves in a radial direction of the cam 57. Hence, when the cam 57 is rotated clockwise as seen in FIG. 7 (i.e., in a direction indicated by arrow 82), the pin 56 moves sequentially along the large arc portion 70, the first connecting portion 72, and the small arc portion 69, resulting in a clockwise rotation of the drive gear 55 as seen in FIG. 6. This in turn causes the driven gear 54 to rotate around the central shaft 52 counterclockwise as seen in FIG. 6. Since the driven gear 54 is connected with the frame 48 as described above, the counterclockwise rotating driven gear 54 integrally rotates the frame 48, the sub frames 49, the second roller 46, and the auxiliary roller 47, around the central shaft 52, placing these members 48, 49, 46, 47 in the state shown in FIGS. 8-11. When the cam 57 is rotated counterclockwise as seen in FIG. 10 (i.e., in a direction indicated by arrow 83) from the state shown in FIGS. 8-11, the pin 56 moves sequentially along the small arc portion 69, the first connecting portion 72, and the large arc portion 70, resulting in a counterclockwise rotation of the drive gear 55 as seen in FIG. 9. This causes the driven gear 54 to rotate clockwise as seen in FIG. 9 around the central shaft 52.

When the frame 48, the sub frames 49, the second roller 46, and the auxiliary roller 47 rotate around the central shaft 52, as described above, the second roller 46 rotates on a circumferential surface of the first roller 45, as shown in FIGS. 4 and 11. In this embodiment, the position of the path switching portion 41 shown in FIG. 4 is defined as "recording-medium ejecting position", and the position of the path switching portion 41 shown in FIG. 11 is defined as "recording-medium reversing position". In the case where image recording is to be performed on only one side (or the first surface) of the recording sheet 74, the path switching portion 41 is held in the recording-medium ejecting position, and the recording sheet 74 is fed along the feed path 23 and transferred to the catch tray 21 without being fed backward and turned over, as shown in FIG. 4.

When the path switching portion 41 is placed in the recording-medium reversing position, the recording sheet 74 is reversed, or fed backward to the upstream side in the first feeding direction, and guided into the switch-back guide path 16, as shown in FIG. 11. More specifically, when an image is to be recorded on both sides or surfaces of the recording sheet 74, after an image is recorded on the first surface, the recording sheet 74 is first fed to the downstream side in the first feeding direction while the path switching portion 41 is held in the recording-medium ejecting position as shown in FIG. 4. Then, the position of the path switching portion 41 is switched from the recording-medium ejecting position to the recording-medium reversing position shown in FIG. 11, in order that the auxiliary roller 47 contacts and holds down the recording sheet 74 so as to guide the recording sheet 74 into the switch-back guide path 16.

[2-6 Guide Portion]

As shown in FIGS. 4 and 11, a guider 76 is disposed downstream of the first roller 45 and the second roller 46 in the first feeding direction. The guider 76 is disposed on a support plate 75 that is attached to the mainbody frame 53. More specifically, the guider 76 has a base portion 77 fixed to an under surface of the support plate 75. The guider 76 further has a guide roller 78 that is held by the base portion 77. More specifically, the base portion 77 has a support shaft 79, and the guide roller 78 is supported by the support shaft 79 such that the guide roller 78 is rotatable around the support shaft 79. In this embodiment, the guide roller 78 is a gear roller having a spur-like shape.

The guider 76 is disposed at a position such that when the first roller 45 and the second roller 46 rotate in the reverse direction to feed the recording sheet 74 into the switch-back guide path 16, the guider 76 contacts the first surface of the recording sheet 74 on which an image has been recorded. The guider 76 does not contact the recording sheet 74 while the first roller 45 and the second roller 46 rotate in the forward direction to eject the recording sheet 74 onto the ejection tray 21. More specifically, the guider 76 is located at a position off an imaginary line that connects a nip or a point of contact between the first roller 45 and the second roller 46, and a nip or a point of contact between the ejection roller 62 and the gear roller 63.

As described later, the recording sheet 74 is reversed in its feeding direction to be fed into the switch-back guide path 16. When the feeding direction of the recording sheet 74 is thus reversed, an orientation of a portion of the recording sheet 74 which is located downstream of the first roller 45 and the second roller 46 in the first feeding direction will change to be parallel to the switch-back guide path 16 due to the rigidity of the recording sheet 74. However, the guide roller 78 contacts the first surface of the recording sheet 74 on which an image has been recorded, thereby bending the recording sheet 74. The recording sheet 74 thus conforms to the circumferential surface of the first roller 45, thereby becoming capable of stably receiving a feeding force. Therefore, the recording sheet 74 is stably fed into the switch-back guide path 16. In the embodiment, the guide roller 78, which is disposed at a position that is downstream of the roller pair constituted by the first roller 45 and the second roller 46 with respect to the first feeding direction of the recording sheet along which the recording sheet 74 is fed in the feed path 23 as the first feed path, and is determined (i) not to interfere with the recording medium which is being ejected by the roller pair such that the first edge is the leading edge and (ii) to contact the recording medium which is being fed into the switch-back guide path 16 as the second feed path by the roller pair such that the second edge that is opposite to the first edge is the leading edge so as to restrict turning of the recording medium around a pinch portion between the roller pair, constitutes a turn restrictor.

3. Control System

FIG. 12 is a block diagram showing the control portion 84 of the multifunction apparatus 10.

The control portion 84 controls not only operation of the printer portion 11 but also general operation of the multifunction apparatus 10 including operation of the scanner portion 12. The control portion 84 is constituted by a main board disposed at an appropriate position in the mainbody frame 53. Since control of the scanner portion 12 is not relevant to the invention, detailed description thereof is not provided.

As shown in FIG. 12, the control portion 84 is constituted as a microcomputer mainly including a CPU (Central Processing Unit) 88, a ROM (Read Only Memory) 89, a RAM (Random Access Memory) 90, and an EEPROM (Electrically Erasable and Programmable ROM) 91. The control portion 84 is connected with an ASIC (Application Specific Integrated Circuit) 93 via a bus 92.

Programs and others for controlling various kinds of operations of the multifunction apparatus 10 are stored in the ROM 89. The RAM 90 is used as a storage area for temporarily storing various kids of data, or as a work area, when the CPU 88 implements the programs. Settings, flags, and other information or data that should be retained even after the multifunction apparatus 10 is turned off are stored in the EEPROM 91.

A rotation of the LF motor 71 is controlled as follows. The ASIC 93 generates signals for controlling the LF motor 71 in accordance with instructions from the CPU 88. These signals include a phase excite signal for energizing the LF motor 71. The phase excite signal is given to a drive circuit 94, which in turn outputs a drive signal to the LF motor 71.

The drive circuit 94 drives the LF motor 71, which is connected with the pickup roller 25, the feeding roller 60, the ejection roller 62, and the first roller 45. The drive circuit 94 receives a signal from the ASIC 93, and generates an electrical signal for rotating the LF motor 71. Receiving the electrical signal, the LF motor 71 rotates, and this rotation is transmitted to the pickup roller 25, the feeding roller 60, the ejection roller 62, and the first roller 45. The transmission of the rotating force of the LF motor 71 to the rollers 25, 60, 62, 45 is made via a known drive mechanism including a gear and a drive shaft. In this way, in the multifunction apparatus 10, the LF motor 71 functions as a drive source for supplying a recording sheet from the sheet supply tray 20, for feeding a recording sheet over the platen 42, and for ejecting a recording sheet onto the catch tray 21 after image recording on the recording sheet is complete.

A rotation of the CR motor 95 is controlled as follows. The ASIC 93 generates signals for controlling the CR motor 95 in accordance with instructions from the CPU 88. These signals include a phase excite signal for energizing the CR motor 95. The phase excite signal is given to a drive circuit 96, which in turn outputs a drive signal to the CR motor 95.

A reciprocation of the carriage 38 is controlled by the control portion 84 as follows. The drive circuit 96 drives the CR motor 95. More specifically, the drive circuit 96 receives a signal from the ASIC 93, and generates an electrical signal for rotating the CR motor 96. Receiving the electrical signal, the CR motor 95 rotates, and this rotation is transmitted to the carriage 38 through a drive mechanism, in order to reciprocate the carriage 38.

A drive circuit 97 shown in FIG. 12 is for controlling an operation of the inkjet recording head 39 at predetermined timings. More specifically, on the basis of a drive control procedure outputted from the CPU 88, the ASIC 93 generates an output signal, based on which the drive circuit 97 controls an operation of the inkjet recording head 39. The drive circuit 97 is implemented on the head control board, and a signal outputted from the drive circuit 97 is a signal transferred from the main board constituting the control portion 84 to the head control board. Receiving the signal the inkjet recording head 39 selectively ejects droplets of inks of different colors at predetermined timings onto a recording sheet. The signal outputted from the drive circuit 97 determines an amount of the inks ejected from the inkjet recording head 39. Hence, based on this signal, the control portion 84 calculates an amount A of the inks having been ejected onto and over a single recording sheet 74. The ink amount A thus calculated is stored in the RAM 90, and thereafter fed back for use in determining an amount of feeding the recording sheet 74 in the reverse direction (which amount will be referred to as "reverse feed amount XL"), as described later.

To the ASIC 93 are further connected the rotary encoder 87 detecting an amount of rotation of the feeding roller 60, the linear encoder 85 detecting the position of the carriage 38, the register sensor 102 detecting the position of the leading and trailing edges of the recording sheet 74, the medium sensor 86 detecting presence or non-presence of the recording sheet 74 over the platen 42, the optical sensor 107, and a humidity sensor 108 detecting a humidity of an atmospheric air around the recording sheet or the multifunction apparatus 10 at the time of image recording. Data representative of the humidity outputted from the humidity sensor 108 is stored in the RAM 90, and thereafter fed back for use in determining the reverse feed amount KL as described later.

When the multifunction apparatus 10 is turned on, the carriage 38 is moved to its initial position corresponding to one of two opposite ends of a sliding range of the carriage 38, and a detection value of the linear encoder 85 representative of the position of the carriage 38 is initialized. As the carriage 38 is moved or slid from the initial position, the optical sensor 107 on the carriage 38 detects the pattern of the encoder strip. The control portion 84 determines an amount of sliding movement of the carriage 38 from the number of pulse signals outputted from the optical sensor 107 as a result of the detection of the pattern of the encoder strip. On the basis of the thus determined amount of sliding movement of the carriage 38, the control portion 84 controls a rotation of the CR motor 95 to control a reciprocation of the carriage 38. On the basis of the output signal from the register sensor 102 and a detection value obtained by the rotary encoder 87, the control portion 84 determines the position of the leading or trailing edge of the recording sheet 74, as well as an amount by which the recording sheet 74 has been fed.

When the leading edge of the recording sheet 74 reaches a predetermined position over the platen 42, the control portion 84 controls a rotation of the LF motor 71 so as to intermittently feed the recording sheet 74 at the predetermined linefeed width. The linefeed width is set based on image recording conditions that are inputted in advance and include the selected resolution. In particular, when high-resolution recording is to be performed, such as when a borderless photograph is to be recorded, the control portion 84 detects the leading and trailing edges of the recording sheet with high precision, on the basis of the result of the detection of presence or non-presence of the recording sheet 74 by the medium sensor 86, and the detection value obtained by the rotary encoder 87. Further, on the basis of the result of the detection of presence or non-presence of the recording sheet 74 by the medium sensor 86, and the detection value obtained by the linear encoder 85, the control portion 84 detects positions of two widthwise or lateral edges of the recording sheet 74 with high precision. On the basis of the thus detected positions of the four edges of the recording sheet 74, namely, the leading and trailing edges and the both lateral edges thereof, the control portion 84 controls ejection of ink droplets by the inkjet recording head 39.

To the ASIC 93 are connectable the scanner portion 12, the operation panel 40 through which various instructions for operating the multifunction apparatus 10 including an instruction for selectively setting the image recording mode can be inputted, the slot portion 43 in which various kinds of small memory cards can be inserted, a parallel interface 98 and a USB interface 99 to which a parallel cable and a USB cable are respectively connectable to enable data transfer with an external information apparatus such as personal computer, and others. When the kind of the recording sheet 74 is determined on the basis of an instruction inputted through the operation panel 40 or a printer driver installed in a personal computer, as described above, data representative of the kind of the recording sheet 74 (hereinafter referred to as "sheet property data") is stored in the RAM 90, and thereafter fed back for use in determining the reverse feed amount KL, as described later. Further, a NCU (Network Control Unit) 100 and a modem 101 for realizing a facsimile function are connectable to the ASIC 93.

4. Operation and effects of the multifunction apparatus

Figure 13:
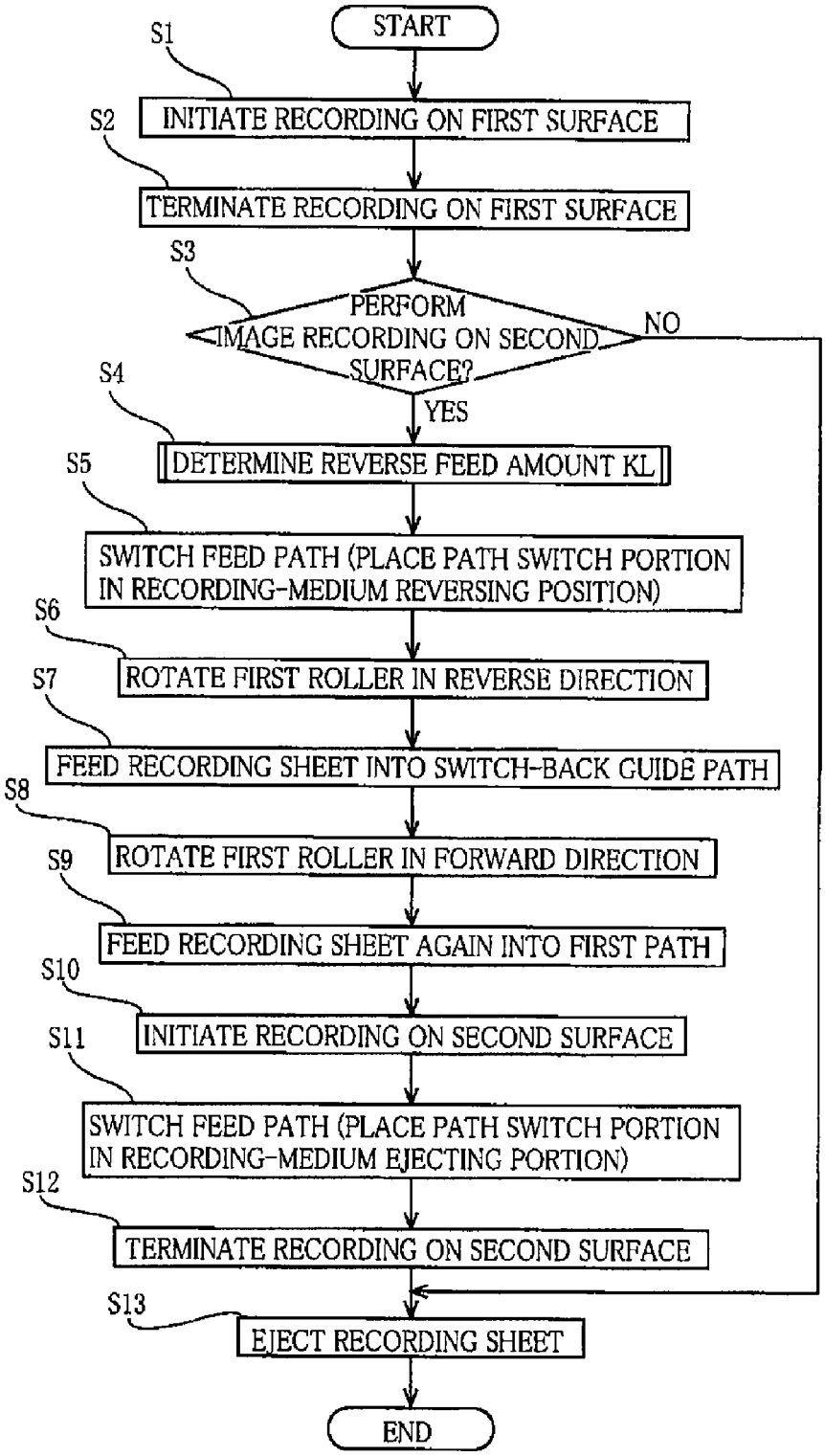
FIG. 13 is a flowchart illustrating how a recording medium is fed when an image is recorded on the recording medium.

FIG. 13 is a flowchart illustrating a procedure of feeding a recording sheet when image recording is performed on the recording sheet.

As shown in FIG. 3, a recording sheet 74 supplied out of the sheet supply tray 20 (shown in FIG. 4) is fed in the direction indicated by arrow 14. More specifically, the recording sheet 74 is fed such that a first end portion 103 (shown in FIG. 4) of the recording sheet 74 is on the leading side, that is, a first edge of the recording sheet 74 on the side of the first end portion 103 is a leading edge, and a second end portion 81 (shown in FIG. 4) of the recording sheet 74 is on the trailing side, that is, a second edge of the recording sheet 74 on the side of the second end portion 81 is a trailing edge. A control flow illustrated in FIG. 13 begins with step S1 in which the recording portion 24 records an image on a first surface of the recording sheet 74 while the recording sheet 74 is being fed over the platen 42 to the downstream side in the first feeding direction by being nipped sequentially between the feeding roller 60 and the pinch roller 31, between the ejection roller 62 and the gear roller 63, and between the first roller 45 and the second roller 46.

During this image recording, the recording sheet 74 is intermittently fed, and every time while the recording sheet 74 is at a stop, the carriage 38 is slid and a part of the image is formed on the first surface of the recording sheet 74. The intermittent feeding of the recording sheet 74 is implemented such that the control portion 84 operates to intermittently rotate the three pairs of rollers, namely, the pair of the feeding roller 60 and the pinch roller 31, the pair of the ejection roller 62 and the gear roller 63, and the pair of the first and second rollers 45, 46. More specifically, while the inkjet recording head 39 ejects ink droplets with the carriage 38 being slid, feeding of the recording sheet 74 is suspended and the recording sheet 74 is halted. While the inkjet recording head 39 does not eject ink droplets, the recording sheet 74 is fed by the predetermined linefeed width.

When the image recording on the first surface of the recording sheet 74 is complete (step S2), the control flow goes to step S3 in which the control portion 84 determines whether the currently selected recording mode is one-side or two-side. The image recording mode is in advance set by the user, for instance through manipulation of the operation panel 40. Data designating the image recording mode and inputted through the operation panel 40 is transferred to the RAM 90 of the control portion 84 to be stored therein. Alternatively, data designating the one-side mode as the image recording mode may be stored in the ROM 89 as a default setting. In a case where the control portion 84 reads from the RAM 90 or the ROM 89 data designating the two-side mode as the image recording mode, an image is recorded on the reverse side or second surface of the recording sheet 74, too.

When the user designates the one-side mode as the image recording mode through manipulation of the operation panel 40 shown in FIG. 1, a negative decision NO is made in step S3, and the control flow goes to step S13. In this case, image recording is performed only on the first surface of the recording sheet 74. That is, as described above, when the one-side mode is designated as the image recording mode, the path switching portion 41 is held in the recording-medium ejecting position (shown in FIG. 4) and the first roller 45 and the second roller 46 are rotated in the forward direction, thereby feeding the recording sheet 74 to the downstream side in the first feeding direction so as to eventually eject the recording sheet 74 onto the catch tray 21.

On the other hand, when the user designates the two-side mode as the image recording mode through manipulation of the operation panel 40, an affirmative decision YES is made in step S3, and the control flow goes to step S4. In this case, image recording is performed on the reverse side or the second surface of the recording sheet 74, too. That is, the path switching portion 41 is initially held in the recording-medium ejecting position (shown in FIG. 4) and the recording sheet 74 is fed to the downstream side in the first feeding direction, and next the path switching portion 41 is placed in the recording-medium reversing position (shown in FIG. 11) and the first and second rollers 45, 46 are rotated in the reverse direction while nipping the recording sheet 74 therebetween so as to feed the recording sheet 74 into the switch-back guide path 16, as described later.

Then, the control portion 84 implements a momentary forward rotation of the roller pair 80, namely, the first and second rollers 45, 46. By the momentary forward rotation, the recording sheet 74 is fed by a predetermined distance or amount backward or in a reverse direction which is opposite to the direction in which the recording sheet 74 was fed until then. Thereafter, the first and second rollers 45, 46 are again rotated in the reverse direction, thereby feeding the recording sheet 74 onto the sheet supply tray 20 through the switch-back guide path 16. In this specification, the predetermined distance or amount is referred to as "reverse feed amount KL". To record an image on the reverse side or second surface of the recording sheet 74, too, initially the reverse feed amount KL is determined in the following manner, in step S4.

Figure 14:
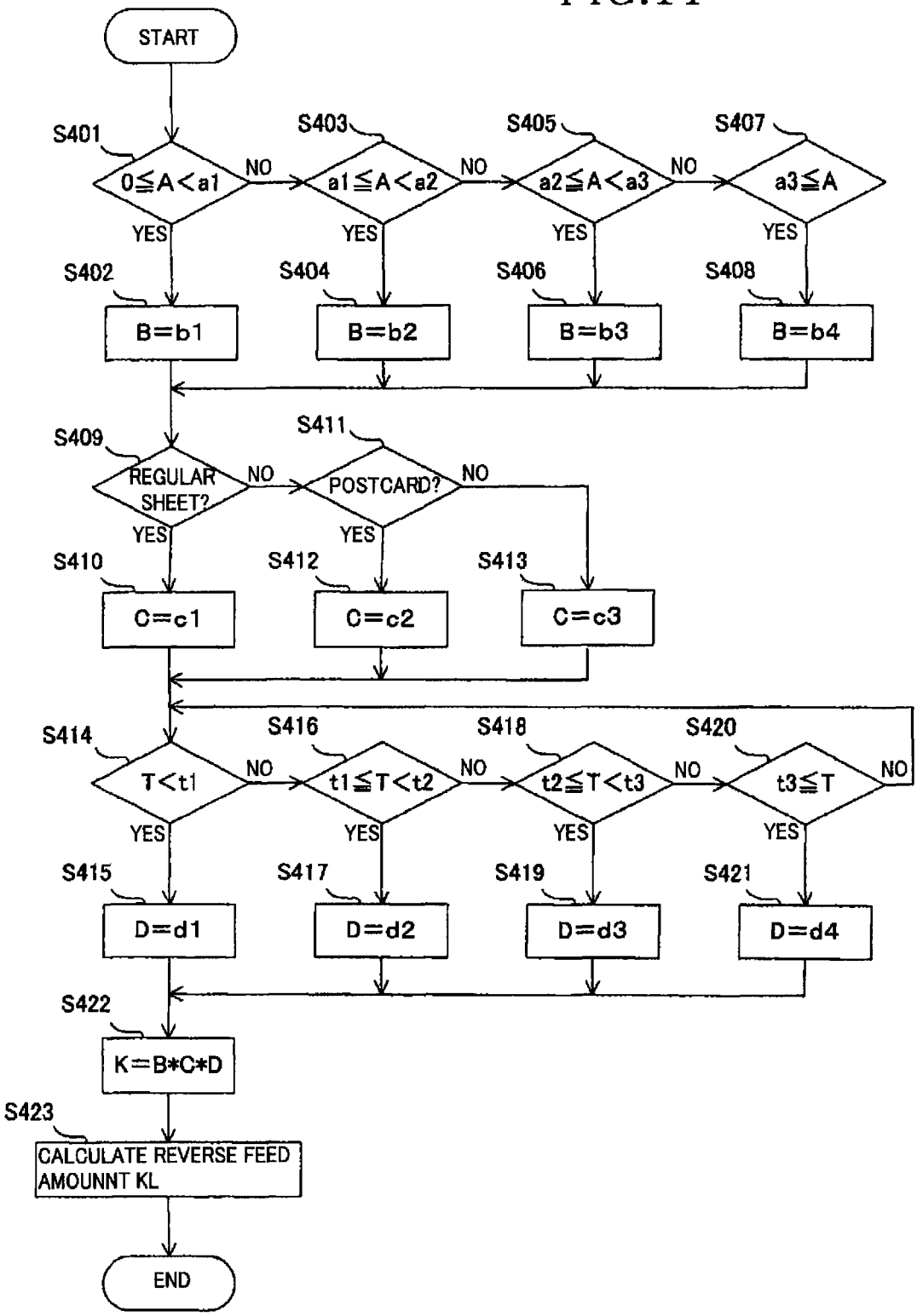
FIG. 14 is a flowchart illustrating a procedure of determining a reverse feed amount.

FIG. 14 is a flowchart illustrating a procedure of determining the reverse feed amount KL in step S4.

To determine the reverse feed amount KL, an amount of the inks ejected from the inkjet recording head 39 is fed back. More specifically, it is determined which one of four predetermined ranges the ink amount A (which represents a total amount of the inks ejected onto the recording sheet 74) corresponds to or falls within. There are predetermined four values of an ink-amount coefficient B respectively corresponding to the four predetermined ranges of the ink amount A, and one of the values of the ink-amount coefficient B corresponding to the thus determined range is determined. That is, first, it is determined whether the ink amount A falls within a range of $0 \leqq A < a1$, in step S401. When the ink amount A falls within this range, an affirmative decision YES is made in step S401 and the control flow goes to step S402 to set the ink-amount coefficient B at b1, and this value is stored in the RAM 90.

On the other hand, when the ink amount A does not fall within the range of $0 \leqq A < a1$, a negative decision NO is made in step S401 and the control flow goes to step S403 to determine whether the ink amount A falls within a range of $a1 \leqq A < a2$. When the ink amount A falls within this range, an affirmative decision YES is made in step S403 and the control flow goes to step S404 to set the ink-amount coefficient B at b2 and store this value in the RAM 90.

When the ink amount A does not fall within the range of $a1 \leqq A < a2$, a negative decision NO is made in step S403, and the control flow goes to step S405 to determine whether the ink amount A falls within a range of $a2 \leqq A < a3$. When the ink amount A falls within this range, an affirmative decision YES is made in step S405 and the control flow goes to step S406 to set the ink-amount coefficient B at b3 and store this value in the RAM 90.

On the other hand, when the ink amount A does not fall within the range of $a2 \leqq A < a3$, a negative decision NO is made in step S405, and the control flow goes to step S407 to determine whether the ink amount A falls within a range of $a3 < A$. When the ink amount A falls within this range, an affirmative decision YES is made in step S407 and the control flow goes to step S408 to set the ink-amount coefficient B at b4 and store this value in the RAM 90.

After step S402, S404, S406 or S408 in which the ink-amount coefficient B is set at one of the four values, the control flow goes to steps S409-S413 to determine a sheet-property coefficient C. That is, for use in the determination of the reverse feed amount KL, the sheet property data of the recording sheet 74, which is set by being inputted through the operation panel 40 or otherwise, is fed back, and the control portion 84 determines the sheet-property coefficient C based on the sheet property data. More specifically, the ROM 89 stores a table defining a correspondence between kinds of recording sheet which the sheet property data can be representative of; and values of the sheet-property coefficient C. The kinds of recording sheet are "regular sheet", "postcard", and "neither of them". After step S402, S404, S406 or S408, the control flow goes to step S409 in which the CPU 88 refers to the table and determines whether the sheet property data temporarily stored in the RAM 90 indicates that the recording sheet 74 to be used is a regular sheet or not. When it is determined that the recording sheet 74 is a regular sheet, an affirmative decision YES is made in step S409 and the control flow goes to step S410 to set the sheet-property coefficient C at c1. This value is stored in the RAM 90.

On the other hand, when the recording sheet 74 is not a regular sheet, a negative decision NO is made in step S409 and the control flow goes to step S411 in which the CPU 88 refers to the table and determines whether the sheet property data temporarily stored in the RAM 90 indicates that the recording sheet 74 in question is a postcard or not. When it is determined that the recording sheet 74 is a postcard, an affirmative decision YES is made in step S411 and the control flow goes to step S410 to set the sheet-property coefficient C at c2 and store this value in the RAM 90.

When it is determined that the recording sheet is neither a regular sheet nor a postcard in steps S409 and S411, the control flow goes to step S413 to set the sheet-property coefficient C at c3 and store this value in the RAM 90.

After step S410, S412 or S413 in which the sheet-property coefficient C is set at one of the three values, the control flow goes to steps S414-S421 to determine a humidity coefficient D. That is, an atmosphere humidity T, which is representative of a humidity of the atmospheric air around the recording sheet 74 at the time of image recording, is fed back for use in the determination of the reverse feed amount KL. Based on data of the humidity detected by the humidity sensor 108, the control portion 84 determines the humidity coefficient D. More specifically, the ROM 89 stores a table defining a correspondence between four humidity value ranges (namely, $T < t1$, $t1 \leqq T < t2$, $t2 \leqq T < t3$, and $t3 \leqq T$) and values of the humidity coefficient D. The CPU 88 refers to the table and determines which one of the four ranges the atmosphere humidity T temporarily stored in the RAM 90 corresponds or falls within.

First, in step S414, it is determined whether the atmosphere humidity T falls within the range of $T < t1$. When it is determined that the atmosphere humidity T falls within this range, an affirmative decision YES is made in step S414 and the control flow goes to step S415 to set the humidity coefficient D at d1. This value is stored in the RAM 90.

When the atmosphere humidity T does not fall within the range of $T < t1$, a negative decision NO is made in step S414 and the control flow goes to step S416 to determine whether the atmosphere humidity T falls within the range of $t1 \leqq T < t2$. When the atmosphere humidity T falls within this range, an affirmative decision YES is made in step S416 and the control flow goes to step S417 to set the humidity coefficient D at d2 and store this value in the RAM 90.

When the atmosphere humidity T does not fall within the range of $t3 \leqq T < t2$, a negative decision NO is made in step S416 and the control flow goes to step S418 to determine whether the atmosphere humidity T falls within the range of $t2 \leqq T < t3$. When the atmosphere humidity T falls within this range, an affirmative decision YES is made in step S418 and the control flow goes to step S419 to set the humidity coefficient D at d3 and store this value in the RAM 90.

When the atmosphere humidity T does not fall within the range of t2≦T<t3, a negative decision NO is made in step S418 and the control flow goes to step S420 to determine whether the atmosphere humidity T falls within the range of t3≦A. When the atmosphere humidity T falls within this range, an affirmative decision YES is made in step S420 and the control flow goes to step S421 to set the humidity coefficient D at d4 and store this value in the RAM 90.

After step S415, S417, S419 or S421, the control flow goes to step S422 in which control portion 84 obtains a reverse feeding coefficient K by multiplying the ink-amount coefficient B, the sheet-property coefficient C, and the humidity coefficient D. Then, the control flow goes to step S423 in which the control portion 84 calculates, based on the reverse feeding coefficient K, the reverse feed amount KL by which the recording sheet 74 is fed backward or in the reverse direction, where L represents a basic reverse-feeding amount. In this embodiment, the basic reverse-feeding amount L is set to correspond to a typically expected bending amount of the recording sheet 74 and stored in the ROM 89. For instance, each of the ink-amount coefficient B, the sheet-property coefficient C, and the humidity coefficient D is determined to be 1.1 to 1.5.

It is so arranged that the ink-amount coefficient B increases with the ink amount A, for the following reason. The more the ink amount A is, the more unevenly the ink droplets are distributed on the recording sheet with respect to the lateral or width direction of the recording sheet 74. Hence, when the ink amount A is relatively large, a variation in the rigidity of the recording sheet 74 in the width direction is also relatively large, and the recording sheet 74 fed into the switch-back guide path 16 bends unevenly with respect to the width direction. In order to eliminate the widthwise unevenness in bending of the recording sheet, when the ink amount A is relatively large, the reverse feed amount KL should be increased, in other words, the ink-amount coefficient B should be set at a relatively large value.

It is so arranged that the sheet-property coefficient C increases with decrease in a thickness of the recording sheet 74. That is, where the thickness of the recording sheet 74 is relatively large, the rigidity of the recording sheet 74 does not much lower even when the recording sheet 74 absorbs the inks, and thus the widthwise unevenness in bending of the recording sheet 74 fed into the switch-back guide path 16 is relatively small. That is, the reverse feed amount KL should be set to be relatively large when the recording sheet 74 is a regular sheet, and relatively small when the recording sheet 74 is a postcard. In other words, the sheet-property coefficient C should be relatively large when the recording sheet 74 is a regular sheet, and relatively small when the recording sheet 74 is a postcard.

It is so arranged that the humidity coefficient D increases with the humidity of the atmospheric air. That is, there is a tendency that as the humidity of the atmospheric air increases, the rigidity of the recording sheet 74 decreases, resulting in increase in the widthwise unevenness in bending of the recording sheet 74 fed into the switch-back guide path 16. Hence, in order to eliminate the widthwise unevenness in bending of the recording sheet, when the humidity of the atmospheric air is relatively high, the reverse feed amount KL should be set to be relatively large, in other words, the humidity coefficient D should be relatively large.

After the reverse feed amount KL is determined as described above, the recording sheet 74 is fed in the following manner, as illustrated in FIG. 13. While the path switching portion 41 is continuously held in the recording-medium ejecting position, the first and second rollers 45, 46, which nip therebetween the recording sheet 74 with an image having been recorded on the first surface thereof, rotate in the forward direction so as to feed the recording sheet 74 toward the catch tray 21.

The position of the second end portion 81 of the recording sheet 74 is obtained by the control portion 84 on the basis of the detection value outputted from the rotary encoder 87 and with reference to the timings at which the signal outputted from the register sensor 102 switches between ON and OFF. In particular, when so-called borderless recording is performed, the control portion 84 obtains the position of the second end portion 81 of the recording sheet 74 on the basis of the result of the detection of the medium sensor 86 and the detection value of the rotary encoder 87.

Then, when a state where the second end portion 81 of the recording sheet 74 reaches the auxiliary roller 47 and the second edge of the recording sheet 74 is located upstream of the auxiliary roller 47 by a small distance is established as shown in FIG. 4 is established, the path switching portion 41 is placed in the recording-medium reversing position in step S5. As a result of this switching in the position of the path switching portion 41 from the recording-medium ejecting position to the recording-medium reversing position, the second end portion 81 of the recording sheet 74 is held down or pushed by the auxiliary roller 47 to go into the switch-back guide path 16, as shown in FIG. 11. In the next step S6, the rotation direction of the first and second rollers 45, 46 is reversed, thereby feeding the recording sheet 74 into and along the switch-back guide path 16 in a second feeding direction. At this time, the recording sheet 74 enters the switch-back guide path 16 with the second end portion 81 thereof being at the front side in the second feeding direction, in other words, with the second edge of the recording sheet 71 which is the edge at the side of the second end portion 81 being the leading edge.

When placed in the recording-medium reversing position, the path switching portion 41 is rotated or turned around the central shaft 52 of the first roller 45. That is, the second roller 46 rotates on the circumferential surface of the first roller 45 while nipping between itself 46 and the first roller 45, with the auxiliary roller 47 holding down or pushing the recording sheet 74. In other words, the second roller 46 rotates on the circumferential surface of the first roller 45 in such a manner as to twine or wind the recording sheet 74 around the first roller 45, thereby easily changing the orientation of the recording sheet 74 toward or into the switch-back guide path 16. In this embodiment, the frame 48 constitutes a rotatable member rotatable around a rotation axis of one of the roller pair corresponding to the first roller 45, the auxiliary roller 47 constitutes a guide roller held by the rotatable member such that the guide roller is rotatable, and the drive mechanism 44 including the driven gear 54, the drive gear 55, and the cam 57 constitutes a driving device which rotates the rotatable member to place the guide roller at one of a non-operating position for not interfering with the recording medium being ejected, and an operating position for contacting and guiding the recording medium being fed into the second feed path corresponding to the switch-back guide path 16 such that the second edge is the leading edge.

The reversely rotating first and second rollers 45, 46 feed the recording sheet 74 into and along the switch-back guide path 16 down onto the sheet supply tray 20. However, in step S8, the control portion 84 temporarily reverse the rotation direction of the first and second rollers 45, 46, that is, temporarily rotate the first and second rollers 45, 46 in the forward direction, before the second edge of the recording sheet 74 that is the edge on the side of the second end portion 81 reaches the pickup roller 25. By this temporary or momentary reverse rotation of the first and second rollers 45, 46, the recording sheet 74 fed into the switch-back guide path 16 is fed backward or in the direction opposite to the second feeding direction, by the predetermined distance amount, namely, the reverse feed amount KL, along the switch-back guide path 16.

When an image is recorded on the recording sheet 74, the ink droplets landed on the recording sheet 74 and forming the image lower the rigidity of the recording sheet 74. This may lead to buckling or bending of the recording sheet 74 in the second feeding direction as the recording sheet 74 is fed into and along the switch-back guide path 16. Further, when the amount A of the inks used for the recording of the image is relatively large, the unevenness in distribution of the ink droplets with respect to the width direction of the recording sheet 74 (i.e., a direction perpendicular to the second feeding direction) is relatively large as described above, and thus the rigidity of the recording sheet 74 becomes uneven in the width direction, resulting in a widthwise unevenness in bending of the recording sheet 74 entering the switch-back guide path 16.

However, according to the multifunction apparatus 10, after the recording sheet 74 enters the switch-back guide path 16 with its second end portion 81 on the front side in the second feeding direction, and before its second edge reaches the pickup roller 25, the first and second rollers 45, 46 are rotated again in the forward direction, in order to reverse, or backward feed, the recording sheet 74 by the reverse feed amount KL. Thus, even when the widthwise unevenness in bending of the second end portion 81 of the recording sheet 74 occurs, this widthwise unevenness is reduced.

In the following step S9, the recording sheet 74 is fed along the switch-back guide path 16 again in the second feeding direction until reaching the pickup roller 25, and then fed by the pickup roller 25 again into the feed path 23. At this time, the recording sheet 74 is not skewed since the widthwise unevenness in bending of the second end portion 81 of the recording sheet 74 has been reduced. Then, the recording sheet is fed to the recording portion 24 again. In this particular embodiment where the switch-back guide path 16 is curved as shown in FIG. 3, the recording sheet 74 is fed along the switch-back guide path 16 such that the second end portion 81 is pressed onto an inner wall surface of the switch-back guide path 16, resulting in a tendency that the widthwise unevenness in bending of the recording sheet 74 is relatively large. However, by backward feeding the recording sheet 74 by the reverse feed amount KL, the widthwise unevenness in bending of the second end portion 81 of the recording sheet 74 is reduced. In addition, since the distance between the recording sheet 74 and the pickup roller 25 when it is resumed to feed the recording sheet 74 toward the pickup roller 25 is relatively small, an amount of a widthwise unevenness in bending of the second end portion 81 that occurs during a period between a moment of the resumption of the feeding toward the pickup roller 25 and a moment of the reaching the pickup roller 25 is relatively small. Thus, the recording sheet 74 is fed by the pickup roller 25 into the feed path 23 with the recording sheet 74 deskewed already.

The recording sheet 74 is fed by the pickup roller 25 with the second end portion 81 thereof on the front or leading side, and with the first end portion 103 thereof on the rear or trailing side. Since the feed path 23 is U-shaped as described above, the recording sheet 74 is turned over as fed along the feed path 23. In step S10 an image is recorded on the reverse side or the second surface of the recording sheet 74. After image recording on the second surface is initiated, the recording sheet 74 is intermittently fed over the platen 42 in the same manner as in the case of image recording on the first surface. In step S11, before the second end portion 81 of the recording sheet 74 again reaches the position corresponding to the path switching portion 41, the position of the path switching portion 41 is restored to the recording-medium ejecting position from the recording-medium reversing position. When the image recording on the second surface of the recording sheet 74 is complete in step S12, the control flow goes to step S13 in which the recording sheet 74 with an image recorded on both sides thereof is nipped between the first and second rollers 45, 46 of the path switching portion 41 to be fed to the downstream side in the first feeding direction. In this step, the first and second rollers 45, 46 are rotated in the forward direction. The recording sheet 74 is thus ejected onto the catch tray 21.

According to the multifunction apparatus 10, the recording sheet 74 on the second surface of which an image is to be recorded is deskewed before again fed by the pickup roller 25 to the recording portion 24. Further, since the widthwise unevenness in bending of the recording sheet 74 is reduced before the recording sheet 74 is registered by the feeding roller 60, it is inhibited that the recording sheet 74 is widthwise out of position at the time of registering. Therefore, it is enabled to perform image recording on both surfaces of a recording sheet with high precision.

In this embodiment, the pickup roller 25 operates to feed again into the feed path 23 the recording sheet 74 coming from the switch-back guide path 16. That is, the pickup roller 25 functions to supplies or feeds the recording sheet 74 into the feed path 23 when image recording is to be performed on the first surface and when image recording is to be performed on the second surface. Hence, the mechanism for feeding the recording sheet 74 into the feed path 23 so as to record an image on the second surface of the recording sheet 74 is simplified. It is noted, however, a roller separate from the pickup roller 25 may be disposed in the switch-back guide path 16 to be dedicated to feeding the recording sheet 74 coming from the switch-back guide path 16 again into the feed path 23.

In the embodiment, the reverse feed amount KL by which the recording sheet 74 is fed backward or in the direction opposite to the second feeding direction is adjusted on the basis of the ink amount A (steps S401-S408 in FIG. 14), the sheet property of the recording sheet 74 (steps S409-S413), and the humidity of the atmospheric air at the time of the image recording (steps S414-S421). Therefore, the reverse feed amount KL is set at a value most appropriate for the conditions of the image recording. That is, the reverse feed amount KL is set at a minimum value capable of sufficiently reducing the widthwise unevenness in bending of the recording sheet 74, thereby reducing the overall time taken to record an image on the both surfaces of the recording sheet 74.

In the embodiment, the recording sheet 74 fed into the switch-back guide path 16 is once reversed or fed in the direction opposite to the second feeding direction before reaching the pickup roller 25, and then fed again in the second feeding direction along the switch-back guide path 16 to the pickup roller 25. It is noted, however, that the procedure of feeding the recording sheet 74 entering the switch-back guide path 16 is not

What is claimed is:

1. An image recording apparatus comprising:

a feeding device which feeds a plurality of recording media one at a time in a first feeding direction along a first feed path including an upstream connecting portion and a downstream connecting portion;

a recording portion which is disposed in the first feed path and located between the upstream connecting portion and the downstream connecting portion to record an image on each of the plurality of recording media;

a second feed path which connects the downstream connecting portion to the upstream connecting portion;

a path switching portion disposed downstream of the downstream connecting portion with respect to the first feeding direction and configured to switch paths through which each of the plurality of recording media is fed;

a roller pair disposed downstream of the downstream connecting portion with respect to the first feeding direction and configured to rotate in a forward direction and a reverse direction;

a feed roller which is disposed in one of the first feed path and the second feed path and feeds each of the plurality of recording media in a second feeding direction along the second feed path toward the recording portion; and a roller-pair controller configured to implement a momentary forward rotation, the roller-pair controller comprising:

a first forward-rotation controlling section configured to control the roller pair to rotate in the forward direction so as to feed a certain recording medium of the plurality of recording media while the roller pair nip the certain recording medium on which the image has been recorded by the recording portion, such that a first edge of the recording medium is the leading edge;

a first reverse-rotation controlling section configured to, subsequent to completion of the control of the first forward-rotation controlling section, control the roller pair to rotate in the reverse direction so as to feed the certain recording medium, while the roller pair nip the certain recording medium between the roller pair, along the second feed path toward the feed roller such that a second edge of the certain recording medium opposite to the first edge is the leading edge;

a second forward-rotation controlling section configured to, subsequent to completion of the control of the first reverse rotation controlling section, control the roller pair to rotate in the forward direction as the momentary forward rotation so as to feed the certain recording medium, while the roller pair nip the certain recording medium between the roller pair, in a direction opposite to the second feeding direction such that the first edge of the certain recording medium is the leading edge, before the certain recording medium fed by the roller pair on the basis of the control of the first reverse-rotation controlling section reaches the feed roller; and a second reverse-rotation controlling section configured to, subsequent to completion of the control of the second forward-rotation controlling section, control the roller pair to rotate in the reverse direction so as to feed the certain recording medium, while the roller pair nip the certain recording medium between the roller pair, along the second feed path toward the feed roller such that the second edge of the certain recording medium is the leading edge.

2. The image recording apparatus according to claim 1, wherein the recording portion is of inkjet type which records the image by ejecting droplets of ink onto each of the plurality of recording media.

3. The image recording apparatus according to claim 2, wherein the roller-pair controller includes a rotation amount determiner which determines an amount of the momentary forward rotation of the roller pair at least on the basis of an amount of the ink ejected by the recording portion.

4. The image recording apparatus according to claim 3, wherein it is determined which one of a predetermined plurality of ranges the amount of the ink ejected by the recording portion falls within, and the amount of the momentary forward rotation is determined to be relatively large when the range within which the amount of the ejected ink is determined to fall is a range of relatively large values.

5. The image recording apparatus according to claim 3, wherein the rotation amount determiner determines the amount of the momentary forward rotation further on the basis of the kind of the certain recording medium.

6. The image recording apparatus according to claim 3, wherein the rotation amount determiner determines the amount of the momentary forward rotation further on the basis of the humidity of an environment in which the image recording apparatus is situated.

7. The image recording apparatus according to claim 1, further comprising:

a medium supply tray capable of accommodating a plurality of recording media, the second feed path extending through the medium supply tray; and a pickup roller which supplies the recording media one by one from the medium supply tray into the first feed path, and also functions as the feed roller.

8. The image recording apparatus according to claim 1, wherein the roller-pair controller includes a rotation amount determiner which determines an amount of the momentary forward rotation of the roller pair at least on the basis of the kind of the certain recording medium.

9. The image recording apparatus according to claim 8, wherein the kind of the certain recording medium is determined in terms of a rigidity thereof, it is determined which one of a predetermined plurality of ranges the rigidity of the certain recording medium falls within, and the amount of the momentary forward rotation is determined to be relatively large when the range within which the rigidity of the certain recording medium is determined to fall is a range of relatively small values.

10. The image recording apparatus according to claim 1, wherein the roller-pair controller includes a rotation amount determiner which determines an amount of the momentary forward rotation of the roller pair at least on the basis of the humidity of an environment in which the image recording apparatus is situated.

11. The image recording apparatus according to claim 10, wherein it is determined which one of a predetermined plurality of ranges the humidity of the environment in which the image recording apparatus is situated falls within, and the amount of the momentary forward rotation is determined to be relatively large when the range within which the humidity of the environment is determined to fall is a range of relatively large values.

12. The image recording apparatus according to claim 1, wherein the roller-pair controller initiates the momentary forward rotation of the roller pair after the second edge reaches a point in the second feed path distant from the feed roller by 30% of an entire distance across which the second edge of the certain recording medium moves with the feeding of the certain recording medium along the second feed path to the feed roller.

13. The image recording apparatus according to claim 1, wherein the path switching portion includes:

a rotatable member which is rotatable around a rotation axis of one of the roller pair;

a guide roller held by the rotatable member at a position upstream of the rotation axis with respect to the first feeding direction such that the guide roller is rotatable; and a driving device which rotates the rotatable member to place the guide roller at one of a non-operating position for not interfering with the certain recording medium which is being ejected by the roller pair such that the first edge is the leading edge, and an operating position for contacting and guiding the certain recording medium which is being fed into the second feed path by the roller pair such that the second edge is the leading edge.

14. The image recording apparatus according to claim 1, further comprising a turn restrictor which is disposed at a position downstream of the roller pair with respect to the first feeding direction, the position being determined (i) not to interfere with the certain recording medium which is being ejected by the roller pair such that the first edge is the leading edge, and (ii) to contact the certain recording medium which is being fed into the second feed path by the roller pair such that the second edge is the leading edge so as to restrict turning of the recording medium around a pinch portion between the roller pair.

15. The image recording apparatus according to claim 1, wherein the second forward-rotation controlling section is configured to control the roller pair when the first edge and the second edge of the certain recording medium are respectively located on an upstream side and a downstream side of the path switching portion in the second feeding direction.

16. The image recording apparatus according to claim 1, wherein the path switching portion comprises a pivotal member pivotable about an axis of one of the roller pair.

17. The image recording apparatus according to claim 16, wherein the path switching portion comprises a guide roller disposed at a distal end portion of the pivotal member.

18. The image recording apparatus according to claim 17, wherein the path switching portion is configured to move such that the guide roller directly presses the certain recording medium so as to move the second edge of the certain recording medium into the second feed path.

19. The image recording apparatus according to claim 1, wherein the first forward-rotation controlling section, the first reverse-rotation controlling section, the second forward-rotation controlling section, and the second reverse-rotation controlling section control the same roller pair.

20. The image recording apparatus according to claim 1, wherein the first feeding direction is a direction directed from the feeding device toward the roller pair, and wherein the roller pair is disposed downstream of the recording portion with respect to the first feeding direction.

21. The image recording apparatus according to claim 1, wherein the roller pair controller further comprises a third forward-rotation controlling section configured to, subsequent to completion of the control of the second reverse-rotation controlling section, control the roller pair to nip the certain recording medium between the roller pair and to rotate in the forward direction so as to eject the certain recording medium such that the second edge of the certain recording medium is the leading edge.

* * * * *